US006412207B1

(12) United States Patent
Crye et al.

(10) Patent No.: US 6,412,207 B1
(45) Date of Patent: Jul. 2, 2002

(54) FIREARM SAFETY AND CONTROL SYSTEM

(75) Inventors: Caleb Clark Crye, 486 9th Ave., Apt. FN5, NY, NY (US) 10018; Dmitry Yavid; Efrain Luke Rodriguez, both of Brooklyn, NY (US)

(73) Assignee: Caleb Clark Crye, Brooklyn, NY (US)

( * ) Notice: Subject to any disclaimer, the term of this patent is extended or adjusted under 35 U.S.C. 154(b) by 0 days.

(21) Appl. No.: 09/265,435

(22) Filed: Mar. 9, 1999

Related U.S. Application Data

(60) Provisional application No. 60/090,516, filed on Jun. 24, 1998, now abandoned.

(51) Int. Cl.[7] ..... F41A 17/06

(52) U.S. Cl. ..... 42/70.06; 42/70.08; 42/70.01

(58) Field of Search ..... 42/70.01, 70.02, 42/70.04, 70.05, 70.06, 70.08, 70.11; 89/148, 150, 154

(56) References Cited

U.S. PATENT DOCUMENTS

| | | | |
|---|---|---|---|
| 3,307,070 | A | 2/1967 | Hutson |
| 3,710,490 | A | 1/1973 | Cornett et al. |
| 3,715,826 | A | 2/1973 | Seifried |
| 3,733,861 | A | 5/1973 | Lester |
| 3,883,041 | A | 5/1975 | Olson |
| 3,939,679 | A | 2/1976 | Barker et al. |
| 3,978,604 | A | 9/1976 | Smith |
| 4,003,152 | A | 1/1977 | Barker et al. |
| 4,031,648 | A | 6/1977 | Thomas |
| 4,067,132 | A | 1/1978 | Smith |
| 4,105,885 | A | 8/1978 | Ovenstein |
| 4,122,620 | A | 10/1978 | Alexander |
| 4,135,320 | A | 1/1979 | Smith |
| 4,136,475 | A | 1/1979 | Centille |
| 4,141,166 | A | 2/1979 | Schultz |
| 4,154,014 | A | 5/1979 | Smith |
| 4,189,712 | A | 2/1980 | Lemelson |
| 4,245,418 | A | 1/1981 | Kennedy |
| 4,326,353 | A | 4/1982 | Ludwig et al. |
| 4,354,189 | A | 10/1982 | Lemelson |
| 4,384,420 | A | 5/1983 | Van Muller |

(List continued on next page.)

FOREIGN PATENT DOCUMENTS

| | | | |
|---|---|---|---|
| DE | 4009372 | * 10/1990 | ..... 42/70.1 |

OTHER PUBLICATIONS

D.R. Weiss, "Smart Gun Technology Project Final Report" Sandra Nat'l Labs, May, 1996 pp. i–x; pp. 1–160.

"Gunmakers Add Personal Touch to Make Firearms Safer", Christian Science Mohiter, Sep. 9, 1997; pp. 1–2.

"Gunmakers Beginning to Feel Legal Pressure", Houston Chronicle, Nov. 23, 1998; pp. 1–3.

"Smart Handgun Knows Its Owner", Business, Houston Chronicle, Jun. 21, 1993.; pp. 1–3.

"Smart Guns Duns Idea, Want End Firearm Abuse" Houston Chronicle, Sep. 12, 1998; pp. 1–2.

(List continued on next page.)

*Primary Examiner*—Stephen M. Johnson
(74) *Attorney, Agent, or Firm*—Lathrop & Clark LLP

(57) ABSTRACT

A firearm safety and control system and a safety magazine therefor are described. In one embodiment, a safety magazine disposed within a firearm disables or enables a firing control mechanism in the firearm upon sensing or not sensing the presence of, or communicating or not communicating with, an external communication and/or enabling device. In another embodiment, the safety magazine locks itself into or unlocks itself from the frame of the firearm upon sensing or not sensing the presence of, or communicating or not communicating with, an external communication and/or enabling devices. The safety magazine may be configured to be received in unmodified, existing, stock firearms.

20 Claims, 17 Drawing Sheets

U.S. PATENT DOCUMENTS

| | | | | |
|---|---|---|---|---|
| 4,428,138 | A | | 1/1984 | Seecamp |
| 4,449,311 | A | | 5/1984 | Giragusian |
| 4,457,071 | A | | 7/1984 | Walkerstein |
| 4,467,545 | A | | 8/1984 | Shaw, Jr. |
| 4,483,370 | A | | 11/1984 | Talasz |
| 4,488,370 | A | | 12/1984 | Lemelson |
| 4,514,922 | A | | 5/1985 | Famer et al. |
| 4,516,346 | A | | 5/1985 | Famer et al. |
| 4,528,765 | A | | 7/1985 | Johnson |
| 4,532,729 | A | | 8/1985 | Van Muller |
| 4,563,827 | A | | 1/1986 | Heltzel |
| 4,603,498 | A | | 8/1986 | Johnson |
| 4,619,062 | A | | 10/1986 | Johnson |
| 4,654,992 | A | | 4/1987 | Lavergue |
| 4,682,435 | A | | 7/1987 | Heltzel |
| 4,761,906 | A | | 8/1988 | Guevara |
| 4,793,085 | A | | 12/1988 | Suvawski |
| 4,798,018 | A | | 1/1989 | Johansson |
| 4,862,619 | A | | 9/1989 | Baldus et al. |
| 4,970,819 | A | | 11/1990 | Mayhak |
| 5,016,376 | A | | 5/1991 | Pugh |
| 5,022,175 | A | | 6/1991 | Oucke et al |
| 5,052,138 | A | | 10/1991 | Crain |
| 5,062,232 | A | | 11/1991 | Eppler |
| 5,068,989 | A | | 12/1991 | Martin |
| 5,081,779 | A | | 1/1992 | Pack |
| 5,083,392 | A | | 1/1992 | Bookstaber |
| 5,168,114 | A | | 12/1992 | Enget |
| 5,171,924 | A | | 12/1992 | Hurey et al. |
| 5,197,818 | A | | 3/1993 | Martin |
| 5,225,612 | A | | 7/1993 | Bernkrant |
| 5,241,769 | A | | 9/1993 | Van Muller |
| 5,272,828 | A | | 12/1993 | Retruck et al. |
| 5,301,448 | A | | 4/1994 | Retruck et al. |
| 5,303,495 | A | | 4/1994 | Harthcock |
| 5,361,526 | A | | 11/1994 | Campbell |
| 5,419,060 | A | | 5/1995 | Choi |
| 5,419,069 | A | | 5/1995 | Murnbleau |
| 5,448,847 | A | | 9/1995 | Teetzel |
| 5,459,957 | A | | 10/1995 | Winer |
| 5,461,812 | A | | 10/1995 | Bennett |
| 5,465,519 | A | | 11/1995 | Blanck |
| 5,467,550 | A | | 11/1995 | Murnbleau |
| 5,502,915 | A | | 4/1996 | Mendelsohn |
| 5,546,690 | A | | 8/1996 | Ciluffo |
| 5,557,872 | A | | 9/1996 | Langner |
| 5,561,935 | A | | 10/1996 | McCarthy et al. |
| 5,564,211 | A | | 10/1996 | Mussberg et al. |
| 5,581,927 | A | | 12/1996 | Meller |
| 5,603,180 | A | | 2/1997 | Houze |
| 5,628,134 | A | | 5/1997 | Wesp et al. |
| 5,638,626 | A | | 6/1997 | Westrom |
| 5,640,794 | A | | 6/1997 | Gardner et al. |
| 5,651,206 | A | | 7/1997 | Mazarazzo |
| 5,671,560 | A | | 9/1997 | Melle |
| 5,675,925 | A | | 10/1997 | Würger |
| 5,704,153 | A | | 1/1998 | Kamanski et al. |
| 5,713,149 | A | | 2/1998 | Cady et al. |
| 5,720,193 | A | | 2/1998 | Dick |
| 5,732,498 | A | | 3/1998 | Arreguin |
| 5,749,166 | A | | 5/1998 | Brooks |
| 5,758,524 | A | | 6/1998 | Yu |
| 5,782,029 | A | | 7/1998 | Brooks |
| 5,953,844 | A | * | 9/1999 | Harling et al. ..... 42/70.06 |
| 5,974,717 | A | * | 11/1999 | Brooks ..... 42/70.11 |

OTHER PUBLICATIONS

"Inventor Colt Battle for Smart Gun name 1 Local Man Saves Firm" Houston Chronicle, Nov. 1, 1996; pp. 1–3.
"Lab Works on Smart Guns" Houston Chronicle, Apr. 17, 1995; pp. 1–3.
"Smart Gun Concept Draws Interest", New York Times, Oct. 25, 1998; pp. 1–4.
"Technofile", New Scientist, Nov. 1, 1997.
"Personal Need Guns—Is the Cure Worse than the Disease?" www.magicnet/nflynn/personal Nov. 20, 1998 pp. 1–2.
"Smart Guns Setting Off Debate", New York Times, Oct. 22, 1998.
"Smart Lock Technology Inc., " http://www.smartlock.com Oct. 29, 1998; pp. 1–3.
"Try New Chip Could Pit Protection of Property . . . " Wall Street Journal, Date Unknown.
"Ready, Aim . . . ", Business Week, Dec. 27, 1993 pp. 34–35.
"Smart Gun is a Hit at Gunshow," New York Times, Jun. 14, 1993.
"Shooting Holes in the Assault Weapons Ban . . . " New York Times, Apr. 13, 1997; p. 8.
"The Search for Smart Guns", U.S. News & World Report, Nov. 28, 1994.; p. 59.
"Is Sense Playing at Home with Guns?" Wall Street Journal, Jul. 16, 1998.
"Can Smart Guns Really Save Lives?" U.S. News & World Report, Dec. 2, 1996; pp. 37–38.
"A Smarter and Safer Handgun", Healty, Sep. 1994.

* cited by examiner

Magazine locked position

Magazine unlocked position

Option 1
Antenna
RF Receiver (UHF*)
Magnetic Switch 110
212
Data
INT
Decoder/CPU
Control out(s)
Battery 206

Option 2
Antenna 220
RF Receiver (UHF*)
Power Conservation Circuit
212
Data
INT
Decoder/CPU 200
Battery 206
Control out(s)
100

332
Battery 328
Antenna 322
Power Conservation Circuit
RF Osillator.
Encoder 324
Magnet 326 (option 1)
300/350

FIREARM SAFETY AND CONTROL SYSTEM

REFERENCE TO RELATED APPLICATIONS

This application claims priority and other benefits from the filing date of U.S. Provisional Patent Appln. Ser. No. 60/090,516 entitled "Weapon System" to Crye, filed Jun. 24, 1998, now abandoned and hereby incorporates same by reference herein in its entirety.

FIELD OF THE INVENTION

The present invention relates to firearm systems, to apparatus and methods of making and using such systems, and to apparatus and methods of making and using individual sub-systems and components employed in such systems.

BACKGROUND OF THE INVENTION

The most frequently used class of firearms employed by law enforcement agencies is semi-automatic handguns such as 9 mm or 38-caliber semi-automatic weapons. Standard in those weapons are thumb and grip, manually operated, button and/or trigger safeties which hinder unintentional firearm discharges. Such mechanisms are almost universally employed to provide a modicum of insurance against unintentional discharge of the weapon. A thumb safety operates by manually shifting the safety lever from its "safe" position to its "fire" position. A grip safety is automatically shifted to its "fire" position when the user's hand engages the stock or handle of the weapon. Neither of those safety mechanisms is wholly effective to prevent the unauthorized use of a firearm, and both have proven unsatisfactory in dealing with a variety of safety concerns.

One area of safety concern is the complete prevention of accidental discharge of weapons so as to avoid unintentional injuries or death. Another safety concern involves weapons, which come into the reach of children or inexperienced firearm users, which are accidentally or improperly discharged, resulting in death or serious injury. Further, a great concern of law enforcement officials is the unfortunate occurrence where a law enforcement officer is shot or killed with the officer's own service weapon. Such incidents most often occur during an attempted arrest of a violent suspect who gains control of the officer's service weapon and then uses it against him.

Persons such as police officers, security guards and correctional facility officers typically carry a firearm for their own protection as well as the protection of others. Such persons are continually exposed to situations where potential assailants must be physically confronted or detained. During the process of being confronted or detained, potential assailants may have the chance to wrest the officer's firearm away from him. The officer then faces the risk that the assailant will use his own firearm against him.

Some sobering statistics for the United States bring light to the breadth and depth of the problems described above. An average of about 16% of all police officers shot each year are shot with their own weapons. Fifteen thousand suicides are committed using firearms each year. At least 500 accidental firearm-related deaths of children occur each year. Seventy-one law enforcement officers were killed in the line of duty in 1991. Firearms were used in 68 of those slayings, including 8 (11.4%) in which officers were killed with their own service weapons.

Adding to the problems caused by unauthorized use of firearms is the sheer number of firearms now in use in the United States, exacerbating further the general acuteness of the problem. For example, the 1993 census showed that 43% of all households admitted to owning firearms, meaning that at least 105 million firearms are now in civilian hands. One and a half million persons employed by private security firms have access to firearms. It is estimated that nearly four million firearms are employed nationwide by police and sheriff's departments, correctional facilities, fire departments, wildlife and forestry management agencies, the FBI, Federal Marshals, Military Police and the Secret Service.

Several safety arrangements have been suggested to make firearms safer. Most such safety arrangements may be classified as follows: (a) mechanically operated lock devices for disabling a weapon; (b) magnetically operated lock devices for disabling a weapon; (c) electronic remote control devices having a separate controlling transmitter and a receiver located on the firearm for disabling a weapon; (d) mechanical combination key lock devices for disabling a weapon; (e) electronically programmable key lock devices for disabling a weapon; (f) audio verification programmable key lock devices for disabling a weapon; (g) fingerprint verification programmable key lock devices for disabling a weapon, and (h) mechanical means for preventing the loading of ammunition into a weapon. Safety arrangements other than the foregoing also have been suggested.

Most firearm safety and control arrangements suggested heretofore have certain drawbacks or disadvantages, including: (a) a need to make substantial or expensive modifications or changes to the firearm prior to the fitting of the safety arrangement; (b) an inability to enable the safety arrangement of the firearm quickly when the firearm is in the possession of an authorized user; (c) unreliability in actual use; (d) an inability to retrofit the safety arrangement in an existing firearm; (e) an inability to retrofit the safety arrangement in a plurality of types of existing firearms: (f) an inability of an authorized user to remove the safety arrangement installed in the firearm in a cost-effective manner, if so desired; (g) the need to carry a physical key for insertion into the firearm to enable the firearm, thereby lengthening the amount of time required for an authorized user to enable the firearm; (h) ammunition disposed inside the firearm that still may be accessed by an unauthorized user, even when the trigger or hammer mechanism is disabled; and (i) safety arrangements that are complicated to use or implement.

Safety and control arrangements for firearm systems, components and methods are well known in the art, some examples of which may be found in the issued U.S. Patents listed in Table 1 below.

TABLE 1

Prior Art Patents

| Patent Number | Title |
|---|---|
| 3,733,861 | Electronic Recognition Door |
| 3,939,679 | Safety System |
| 4,003,152 | Safety System |
| 4,067,132 | Safety Device for Preventing the Unauthorized Firing of a Weapon |
| 4,105,885 | Hand-Operated Instruments Having Non-Magnetic Safety Switch |
| 4,135,320 | Magnetically Actuable Safety Apparatus |
| 4,154,014 | Magnetically Actuable Safety Apparatus for Preventing Unauthorized Actuation of a Touch-Operable Device |
| 4,189,712 | Switch and Lock Activating System and Method |
| 4,354,189 | Switch and Lock Activating System and Method |
| 4,384,420 | Firearm Magazine Lock |
| 4,457,091 | Firearm Safety Lock |

TABLE 1-continued

Prior Art Patents

| Patent Number | Title |
|---|---|
| 4,467,545 | Personalized Safety method and Apparatus for a Hand Held Weapon |
| 4,488,370 | Weapon Control System and Method |
| 4,532,729 | Firearm Magazine Lock |
| 4,563,827 | Safety System for Disabling a Firearm |
| 4,619,062 | Safety Device for Firearms Using Removable Magazines |
| 4,682,435 | Safety System for Disabling a Firearm |
| 4,761,906 | Firearm Safety Device |
| 4,793,085 | Electronic Firing System for Target Pistol |
| 4,970,819 | Firearm Safety System and Method |
| 5,016,376 | Magnetic Actuated Firearms Locking Mechanism |
| 5,022,175 | Safety Arrangement for Firearms |
| 5,052,138 | Ammunition Supply Indicating System |
| 5,062,232 | Safety Device for Firearms |
| 5,068,989 | Means for Reducing the Criminal Usefulness of Dischargeable Hand Weapons |
| 5,083,392 | Firearm with Piezoelectric triggering and Firing Mechanism |
| 5,168,114 | Automatic Gun Safety Device |
| 5,192,818 | Means for Reducing the criminal Usefulness of Hand Weapons |
| 5,272,828 | Combined Cartridge Magazine and Power supply for a Firearm |
| 5,301,448 | Firearm Safety System |
| 5,303,495 | Personal Weapon System |
| 5,448,847 | Weapon Lock and Target Authenticating Apparatus |
| 5,459,957 | Gun Security and Safety System |
| 5,461,812 | Method and Apparatus for a Weapon Firing Safety Apparatus |
| 5,502,915 | Gun |
| 5,546,690 | Audio Controlled Gun Locking Mechanism |
| 5,561,935 | Trigger Lock for Firearms |
| 5,564,211 | Normally Enabled Firearm Control System That Is Directionally Disabled |
| 5,581,927 | Firearm with Safety Device |
| 5,603,180 | Hand Gun with Remotely Controlled Safety System |
| 5,651,206 | Safety Device |
| 5,671,560 | Firearm with Safety Device |
| 5,675,925 | System for Rendering a Hand Weapon Inoperable |
| 5,704,153 | Firearm Battery and Control |
| 5,713,149 | Electronic Trigger Lock |
| 5,720,193 | Push Button Firearm Lock |
| 5,732,498 | Tamper Proof Multi-Functional Multipurpose Firearm Safety Lock |
| 5,749,166 | Gun Lock Assembly |
| 5,758,524 | Handle Mounted Locking Apparatus and Method |

Particular attention is directed to the following prior art patents: U.S. Pat. No. 3,939,679 to Barker et al.; U.S. Pat. No. 4,003,152 to Barker et al.; U.S. Pat. No. 4,154,014 to Smith; U.S. Pat. No. 4,189,712 to Lemelson; U.S. Pat. No. 4,354,189 to Lemelson; U.S. Pat. No. 4,488,370 to Lemelson; U.S. Pat. No. 5,016,376 to Pugh; U.S. Pat. No. 5,062.232 to Eppler; U.S. Pat. No. 5,168,114 to Enget; U.S. Pat. No. 5,272,828 to Petrick et al.; U.S. Pat. No. 5,303,495 to Harthcock; U.S. Pat. No. 5,459,957 to Winer; U.S. Pat. No. 5,461,812 to Bennett; U.S. Pat. No. 5,675,925 to Wurger and U.S. Pat. No. 5,704,153 to Kaminski et al. Prior art references other than those highlighted in this paragraph may also be of particular relevance to the present invention.

Those of skill in the art will appreciate readily upon reading the Summary of the Invention, Detailed Description of the Preferred Embodiments and Claims set forth below, that at least some of the systems, components, devices and methods disclosed in the patents of Table 1 may be modified advantageously in accordance with the teachings of the present invention.

SUMMARY OF THE INVENTION

The present invention has certain objects. That is, the present invention provides solutions to many problems existing in the prior art respecting safety and control arrangements for firearm systems, components and methods. Known firearm safety arrangements or systems suffer from various problems, including one or more of firearm safety and/or control arrangements or systems, and/or components, subsystems, elements or methods thereof that (a) do not prevent unauthorized persons, including criminals or children, from discharging firearms; (b) may not be retrofitted in an existing firearm and therefore require an entirely new weapon; (c) require extensive, time-consuming or costly modifications to an existing firearm; (d) may be employed in only one particular type of firearm; (e) are irreversible in a firearm once implemented; (f) contain needlesly complicated and elaborate mechanisms or electronics; (g) are failure-prone; (h) not accepted or trusted by law enforcement agencies; (i) are permitted to operate or be employed only in a law enforcement context; (j) do not permit standard methodologies or practices respecting weapon use to be employed; (k) do not permit a user to selectively control important parameters or functions of the system or arrangement; (l) are difficult or expensive to manufacture; (m) are bulky or unwieldy, resulting in a firearm that may be impractical or difficult to use in a law enforcement setting where effective concealment and holster use of a firearm may be required; (n) require time-consuming or elaborate operation procedures; (o) are characterized in having slow device reaction times; (p) are noisy in operation and therefore hinder concealment; (q) require a bulky or unwieldy device to be worn or attached to an intended or authorized firearm user; (r) may be used for a short period of time only before battery recharging or replacement is required; (s) do not acquire, collect or store data respecting firearm use; (t) cannot withstand harsh environmental conditions; (u) cannot be disabled by remote control, and (v) cannot be disabled or enabled in the event of an electrical power failure or other malfunction. Various embodiments of the present invention have the object of solving at least some of the foregoing problems.

In comparison to known firearm safety and control arrangements and/or systems, subsystems, components, elements and/or methods thereof, various embodiments of the present invention provide numerous advantages, including one or more of: (a) preventing unauthorized persons, including criminals or children, from discharging a firearm; (b) being easily retrofittable in a variety of different types of existing firearms; (c) being affordable, economically feasible or cost effective for many different types of potential users; (d) being completely separable from a firearm; (e) being usable in a wide variety of different types of firearms; (f) having simple, reliable and robust mechanisms and methods; (g) permitting a user to employ a familiar trusted firearm; (h) being usable by both law enforcement agencies and civilians; (i) having one or more user-defined or customizable functional parameters; (j) being manufacturable using relatively straightforward and well known manufacturing and fabrication methods; (k) permitting use without compromising or interfering with concealment or holster requirements; (l) permitting quiet, immediate safety and/or control system, subsystem, element or component enabling or disabling; (m) having a small, light-weight, unobtrusive, readily concealed, low-maintenance local or remote external enabling and/or communication device worn, attached to or positioned near or remotely from an authorized weapon user; (n) permitting use over a relatively long period of time before battery recharging or replacement is required; (o) permitting the acquisition and/or storage of data respecting firearm use; (p) permitting the uploading, transfer or telemetry of data, either stored or transferred in real time or otherwise, respecting firearm use to an external device or system, either by remote or in-situ control; (q) permitting data relating to a firearm, such as user I.D., location, time, number of shots fired, direction or orientation of shots fired, etc., to be transferred to one or more external devices or locations for storage and/or analysis; (r) permitting an authorized user to employ a small, easily-concealed, low-maintenance device which enables or disables firing of a firearm; (s) permitting a firearm's physical location to be remotely pinpointed, approximated or monitored; (t) functioning reliably and effectively under harsh environmental conditions, and (u) permitting mechanical override of disabled but normally electrically enabled or disabled functions.

Various embodiments of the present invention have certain features, or physical or functional characteristics, including a firearm safety and/or control arrangement or system, sub-system, component, element or method having one or more of: (a) a magazine that may be retrofitted in an existing firearm, and which replaces the firearm's original equipment magazine while requiring little or no modification of the firearm frame or body; (b) a firearm frame or body configured to receive a safety magazine of the present invention; (c) a safety magazine; (d) a mobile or stationary external local enabling and/or communication device, external to the firearm frame or body, and preferably comprising one or more of a transceiver, a transponder, an antenna, a sensor, a Hall Effect sensor, a magnet and a coil; (d) a mobile or stationary external remote enabling and/or communication device, external to the firearm frame or body, and preferably comprising one or more of a transceiver, a transponder, an antenna, a sensor, a Hall Effect sensor, a magnet, a coil, a satellite, a broadcast antenna, and an antenna; (e) a first motion translation mechanism; (f) a second motion translation mechanism; (g) a motion generation device; (h) an interference member having an interference surface or portion which blocks or disables operation of at least one firing control mechanism disposed in a firearm; (l) a magazine locking member; (m) an interference surface or portion of a magazine locking member; (o) a magazine locking member disposed in at least one of a magazine, a corresponding magazine frame and a firearm frame, the interference member retaining the magazine in the firearm frame or magazine frame upon receipt or lack of receipt of a control signal reflected from, or transmitted or modified by, a local or remote communication and/or enabling device; (p) transceiver or transponder circuitry for receiving and/or sensing a control signal from a local or remote communication and/or enabling device, the circuitry being disposed in the magazine and preferably including at least one of a sensor, a Hall Effect sensor, a coil and an antenna; (q) a trigger mechanism disabling or blocking device; (r) a firing pin disabling or blocking device; (s) means for disabling a trigger mechanism or firing pin, the disabling means being disposed in a removable safety magazine and being actuated by receipt or lack of receipt of a control signal reflected from, or transmitted or modified by, a local or remote communication and/or enabling device; (t) one or more microcontrollers, microprocessors, CPUs, decoders, mini-computers or controllers disposed in a removable safety magazine for controlling actuation of at least one firing control mechanism, for controlling communications or sensing of the presence of a remote or local communication and/or enabling device, and/or for controlling charging or recharging of secondary cells contained therein; (u) at least one firing control mechanism; (v) a trigger linkage interference surface or portion; (w) a magazine sleeve; (x) a magazine chassis; (y) a "smart" portion of a safety magazine; (z) a "dumb" portion of a safety magazine; (aa) an ammunition conveyance mechanism; (bb) an ammunition blocking or interference member; (cc) a magnetic switch; (dd) safety magazine circuitry; (ee) a safety magazine control module; (ff) a safety magazine control module housing; (gg) local or remote external enabling and/or communication device circuitry; (hh) one or more round, coin, cylindrical, prismatic or custom-configured primary or secondary electrochemical cells or batteries arranged electrically in parallel or series, such cells or batteries being disposed in a removable safety magazine, the cells or batteries providing electrical power to the safety magazine; (ii) one or more secondary electrochemical cells or batteries that may be recharged externally or in-situ by conventional direct electrical coupling, inductive coupling or other means; and/or (j) a communication and/or enabling system capable of sensing and/or decoding a color or colors, voice or other biometric data such as fingerprints associated with an authorized user.

BRIEF DESCRIPTION OF THE DRAWINGS

The foregoing aspects and other features of the invention are explained in the following description, taken in connection with the accompanying drawings, wherein:

FIG. 19(*b*) shows another embodiment of a block diagram of an active transceiver system of the present invention;

FIG. 19(*c*) shows one embodiment of a block diagram of external local and/or remote communication and/or enabling device active circuitry of the present invention;

FIG. 20(*b*) shows a detailed circuit diagram of low duty cycle safety magazine circuitry corresponding to the active circuitry of FIG. 20(*a*);

DETAILED DESCRIPTION OF THE PREFERRED EMBODIMENTS

As used in the specification and claims hereof, the following terms have the particular meanings and definitions set forth below.

The terms "weapon", "handgun", "firearm", "gun", "pistol", and "rifle" are essentially synonymous and mean a firearm capable of firing bullets or shotgun shells in a directed manner controllable by an authorized user, where the firearm may be fired only by the authorized user.

The term "conventional firearm" means a firearm capable of firing projectiles, bullets or shotgun shells in a directed manner controllable by a user, where the firearm may be fired by any user familiar with handgun operation.

The term "firing control mechanism" refers to any one of the mechanisms potentially disposed in a firearm which control, enable or disable firing of a projectile therefrom, including, but not limited to, one or more of a trigger, a trigger linkage mechanism, a sear, a sear portion, a hammer, a firing pin, a firing pin mechanism, a safety, a safety mechanism, a slide, a trigger linkage interference surface or portion, a de-cocking lever or mechanism (such s of the type employed in SIG-SAUR® weapons) and an ammunition conveyance mechanism. The terms "local external enabling and/or communication device" and "remote external enabling and/or communication device" include devices capable of communicating with, enabling or disabling, or having their proximity or nearness being sensed by, circuitry disposed in a safety magazine of the present invention, such remote or local devices communicating, enabling, disabling or being sensed by the safety magazine by one or more of digital, analog, magnetic, electromagnetic, electrical, acoustic, sub- or supra-acoustic, magnetic or electric signal, flux or field, telephonic, cellular telephone, multiplexed or not multiplexed, optical or mechanical means.

The term "safety magazine" means a device that holds or carries ammunition or other projectiles therein for discharge by a firearm, and that is capable of at least one of disabling at least one firing control mechanism in the firearm and controllably locking itself in the firearm so that an unauthorized person may not remove it therefrom.

Figure 1:
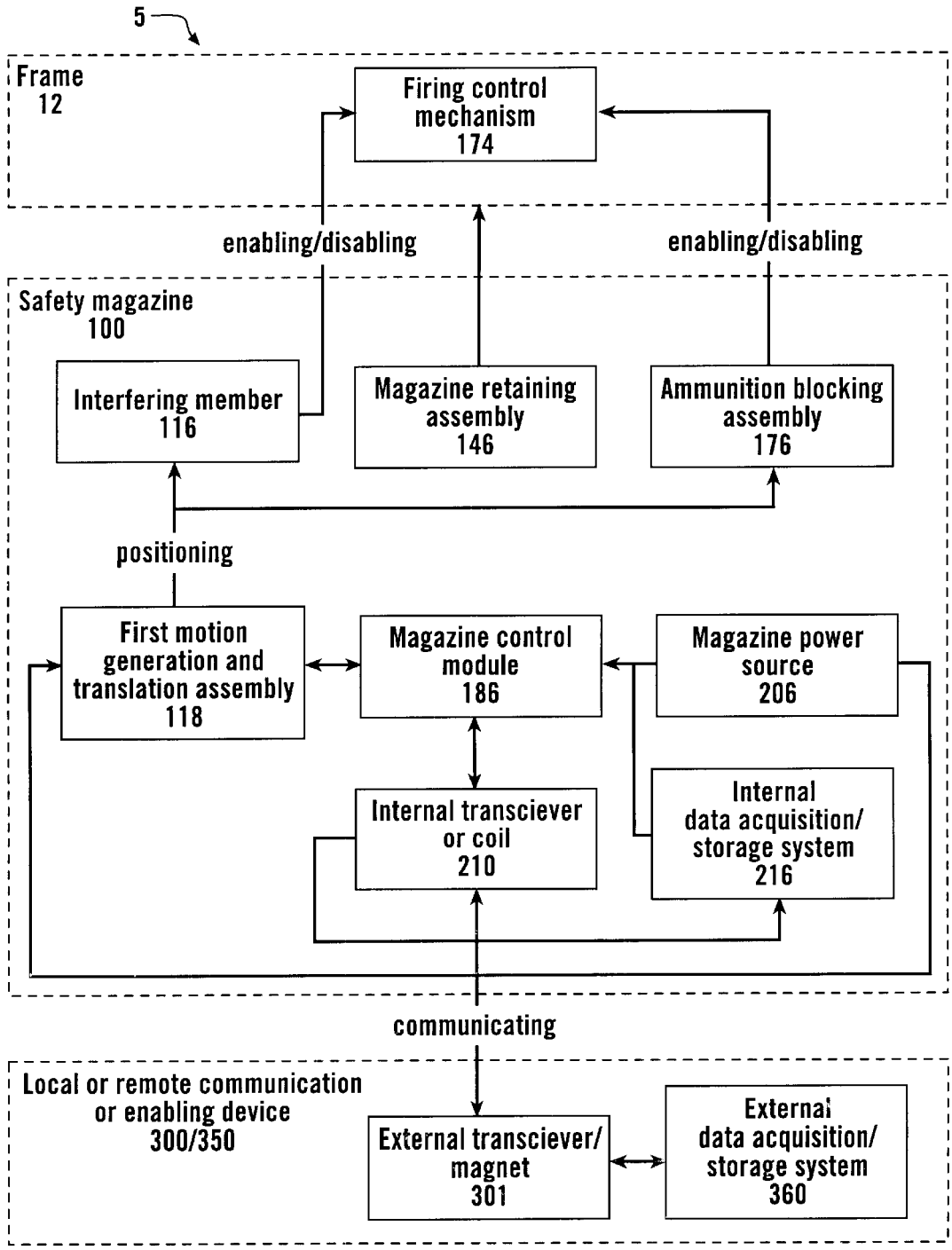
FIG. 1 shows a block diagram of one embodiment of a firearm safety and control system of the present invention.
Figure 4:
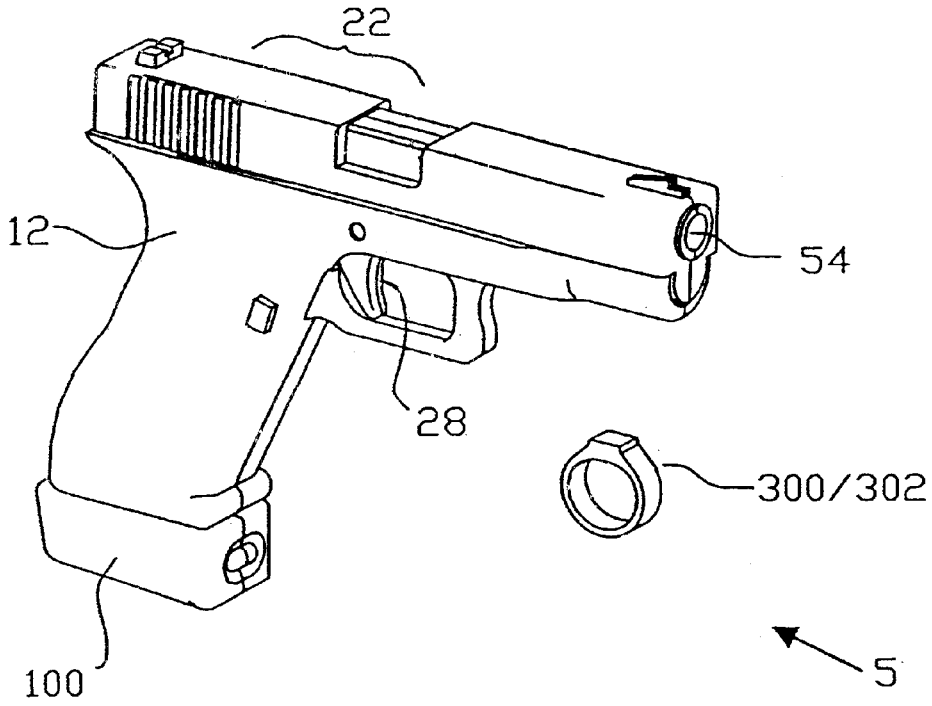
FIG. 4 shows a perspective view of one embodiment of a firearm system of the present invention.
Figure 5:
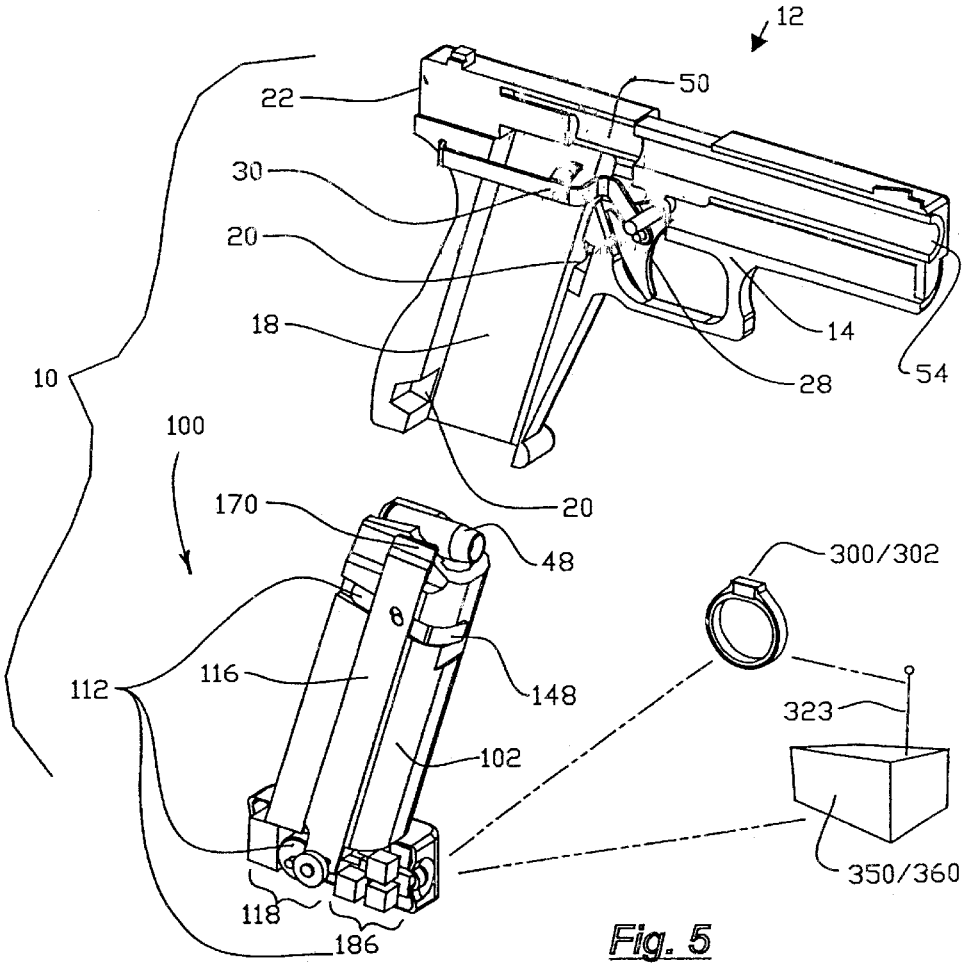
FIG. 5 shows an exploded perspective partial cross-sectional view of the system of FIG. 4 and external remote communication or enabling device 350.

I refer first to FIGS. 1, 4 and 5 to provide an overview of one embodiment of the present invention. Firearm 10 includes safety magazine 100 having magazine interference assembly 112 incorporated therein or thereon. Interference assembly includes motion generation device 192, which may be, by way of example, a solenoid attached to a movable interference member 116. In one embodiment of the present invention, when the solenoid is energized and de-energized, interference member 116 can be moved out of and into the path of some portion of trigger linkage 30, or of some other component of firing control mechanism 174 (such as a firing pin or ammunition conveyance mechanism). When some portion of interference member 116 is located in the path of some portion of firing control mechanism 174, interference member 116 prevents trigger 28 from moving rearward to actuate firing of ammunition or projectile 48 from firearm 10 from firing chamber 50 and bore 54.

In one preferred embodiment of the present invention, interference member 116 is normally located in the path or otherwise blocks movement of trigger linkage 30, trigger 28, the firing pin or other component of firing control mechanism 174 when the solenoid or other motion generation device 192 is de-energized or disabled. In one alternative embodiment of the present invention, however, interference member 116 may block or be located in the path of trigger linkage mechanism 30 or other component of firing control mechanism 174 only when the solenoid or other motion generation device 192 is energized and/or enabled. In still other alternative embodiments of the present invention, any suitable type of motion generation device 192 may be provided, such as a micro-motor or piezoelectric apparatus attached to interference member 116. In yet another alternative embodiment of the present invention, interference member 116 is moved into an interfering position in respect of some component of firing control mechanism 174 once motion generation system is energized and/or enabled—thereafter, when the supply of electric power to motion generation device 192 is cut or removed, interference member 116 remains in a blocking or interfering position in respect of the component of firing control mechanism 174.

In the present invention, any suitable type of firing control mechanism 174 or interference member 116 may also be provided. One embodiment of interference member 116 of the present invention, for example, is a pin which moves into and out of an interfering position in respect of some portion of firing control mechanism 174 under the control of an actuable solenoid, electric motor or other suitable motion generation device 192. In another embodiment of the present invention, a geared motor 192 drives a selector gear or other member into and out of an interfering position in respect of some portion of firing control mechanism 174.

As best seen in FIGS. 4 and 5, firearm 10 includes safety magazine 100, which is inserted in recess 18 of frame 12. In alternative embodiments of the present invention, safety magazine 100 is sized, shaped and configured for attachment or insertion in any suitable location on frame 12. In a preferred embodiment of the present invention, safety magazine 100 may be attached to or inserted in, and operate successfully in conjunction with, unmodified conventional frame 12. That is, the conventional magazine typically provided with firearm 10 may be replaced with safety magazine 100 of the present invention, and safety magazine 100 may operate in or on firearm 10 without modification of frame 12.

Referring also to FIGS. 1, 2, 4, 5, 6, 7, 8, 9 and 10, safety magazine 100 includes one or more of magazine sleeve 102, magazine chassis 104, "smart" portion 106, "dumb" or ammunition holding and conveying portion 108, first motion translation mechanism 118, second motion translation mechanism 155, interference member 116, magazine locking member 148, interference surface or portion 149, safety magazine control module 186, motion generation device 192, magazine control module housing 198, electric power source 206 and internal transceiver, coil or receiving and/or transmitting means 210. It is preferred that safety magazine 100 be removeably connected to or inserted in frame 12.

In one embodiment of the present invention, safety magazine control module 186 comprises a printed circuit board having microprocessor, microcontroller, micro-computer, CPU, decoder, or power relay 200 mounted thereon or attached thereto. Electrical power source or battery 206 is connected to and powers microprocessor 200 which controls whether or not energy from battery 206 is employed to energize, for example, solenoid 192. Module 186 actuates or controls motion generation device 192 in response to sensed enabling or disabling signals and/or communications received from local enabling and/or communication device 300 and/or remote enabling and/or communication device 350. Device 300 may be a ring 302, for example, which when removed more than a predetermined maximum proximity or range from firearm 10 results in disablement of firing control mechanism 174 and/or locking of safety magazine 100 in, firearm 10. In another embodiment of the present invention, device 350 may be a satellite 352 or cellular telephone, microwave or other type of communication tower or device through which enabling, disabling, locking, unlocking or other control signals are transmitted to safety magazine 100 from a central command post such as, by way of example, a police station. In still other embodiments of the present invention, firearm 10 and safety magazine 100 may be controlled, enabled, disabled or communicated with by either one or both of local device 300 and remote device 350, and the operation of devices 300, 350 and magazine 100 may further be coordinated, controlled and augmented through the use of Global Positioning Systems (GPS) and/or Local Positioning Systems (LPS) well know in the art.

It is preferred that electrical power source 206 be a secondary or rechargeable battery. One or more electrical inputs or connectors may be provided in safety magazine 100 to permit connection of an external battery recharger thereto. Many different types of battery rechargers and chargers well known in the art would be suitable for use in the present invention. For example, such a battery charger could be an external AC transformer comprising electrical terminals for insertion into a household electrical outlet, a plug for insertion into a suitable terminal disposed in safety magazine 100, and indicator lights or LEDs for signalling battery state of charge. Batteries 206 could also be removeable from safety magazine 100 for direct recharging in an external battery charger.

In one embodiment of the present invention, internal transceiver or coil 210 sends and/or receives radio signals. In a preferred embodiment of the present invention, transceiver 210 is only active when local device 300 is located within a predetermined range of firearm 10. Safety magazine control module 186 may control the provision of electrical power to safety magazine circuitry 212 such as the circuitry included in transceiver 210 from battery 206, in conjunction with firearm 10, local enabling and/or communication device 300 and/or remote enabling and/or communication device form firearm system 5. Device 300 may be finger ring 302 intended to be worn by an authorized user. Ring 302 may comprise a radio frequency transponder 86. When the transmitter section of internal transceiver 210 sends out a predetermined signal, the transponder included in ring 302 receives the signal and re-transmits the original signal, or a coded or modified version thereof, back to a receiver section included in internal transceiver 210. After internal transceiver 210 has successfully received the original or modified signal from ring 302, internal transceiver 210 sends a signal to safety magazine control module 186. Module 186, in turn, sends a control signal to motion generation device 192 which causes interference member 116 or another member attached or linked thereto to move into or out of an interfering or locking position in respect of at least some portion of firing control mechanism 174 and/or magazine locking member 148 such that firearm 10 may be fired (or may not be fired) and/or such that safety magazine 100 may be removed from frame 10 (or may not be removed from frame 12).

In a preferred embodiment of the present invention, once safety magazine control module 186 receives the proper signal from internal transceiver 210, control module 186 terminates or suspends the provision of electrical power to internal transceiver 210 for a predetermined period of time to conserve charge in battery 206. Control module 186 keeps interference member 116 in a non-interfering position during the predetermined period of time, at the expiration of the predetermined period of time, transceiver 210 is awakened by module 186 and transceiver 210 repeats the process of transmitting the predetermined signal for re-transmission or modification by device 300 and/or device 350. The signal range of transceiver 210 and local or remote device 300 or 350 are typically limited. It is preferred that transceiver 210 and local device 300 have a maximum interactive signal range of about three feet. Such a signal range may be varied between about one inch and about five feet (or even further) based upon, by way of example, variations in the amount of electrical power provided to transceiver 210 and external local device 300.

It is preferred that internal transceiver 210 and external local or remote device operate in radio frequencies somewhere near or in the 900 MHz range. Signal range of the present invention may also be configured on the basis of antenna length and/or shielding in safety magazine 100. Signals transmitted between internal transceiver 210 and external local or remote device are preferably coded, such as, for example, by pulse, amplitude, phase or frequency coding. Only if internal transceiver 210 and external local or remote device 300 or 350 are within a predetermined maximum range of one another does control module 186 move interference member 116 or magazine locking member 148 out of an interfering or locking position. The predetermined maximum range may be adjustable by the authorized user so that it may range between a few inches or feet to several tens of feet, several hundred yards, several miles or even further. The present invention may additionally be configured such that proper predetermined signals must be received from local or remote device 300 and/or 350 by transceiver 210 for control module 186 to maintain or move interference member 116 into a non-interfering position, and/or for control module 186 to maintain or move magazine locking member 148 into an unlocked position. Local or remote devices 300 and 350 may have their own power supplies disposed therewithin, or may instead employ power provided by the transceiver signal in order to supply a return signal to transceiver 210.

Rather than employ a transponder, local or remote device 300 or 350 may comprise an external transceiver and associated additional circuitry. It is preferred that the signal frequency and/or recognition code of each firearm 10 be unique such that only a single designated firearm and a corresponding unique external local or remote enabling and/or communication device 300 and/or 350 may be used successfully together. It is contemplated in the present invention, however that groups or pairs of firearms 10 could be similarly programmed or configured, such as in the case of police officer partners.

In another embodiment of the present invention, external transceiver or magnet 301 may be located in police badge 310 or other article of clothing or attire. External transceiver 301 may also be positioned on an authorized user such that transceiver 301 is easily reachable by the user and may be thrown easily away from him, such as in the event the user is in a struggle with a criminal for firearm 10. By throwing local external transponder or transceiver 300 beyond the predetermined range of firearm 10, firearm 10 becomes unable to fire, thereby preventing the criminal from shooting the rightful user with his own firearm.

In yet another embodiment of the present invention, firearm 10 and/or safety magazine 100 may include an emergency off switch that may be activated mechanically, electro-mechanically, magnetically or electrically by the user. Firearm 10 may also comprise an emergency control mechanically or otherwise actuable by a user to position interference member 116 and/or magazine locking member 148 in a non-interfering or unlocked position, and/or in an interfering or locking position. It is preferred that such an emergency control comprise a code control mechanism having keys or push buttons that must be actuated in a predetermined sequence before interference member 116 is moved mechanically into a non-interfering position and/or magazine locking mechanism 148 is moved mechanically into an unlocked position. In this embodiment of the present invention, even if any one of battery 206, motion generation device 192. external local enabling and/or communication device 300, external remote enabling and/or communication device 350, internal transceiver 210, external transceiver 301, or any part of safety magazine control module 186 fails, an authorized user who knows the code for emergency control may controllably place the firearm into (or out of) operation.

Figure 21A:
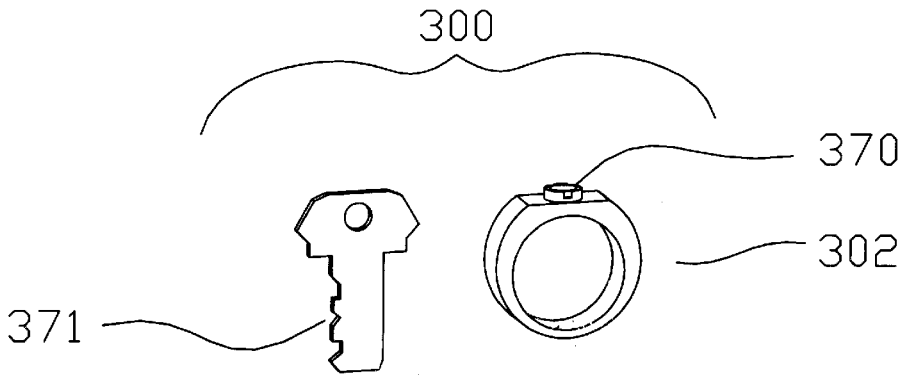
FIG. 21(*a*) shows some embodiments of a key and a key ring of the external local communication or enabling device 300 of the present invention, and FIG. 21(*b*) shows one embodiment of a safety magazine of the present invention having a key socket and a keypad disposed thereon.
Figure 21B:
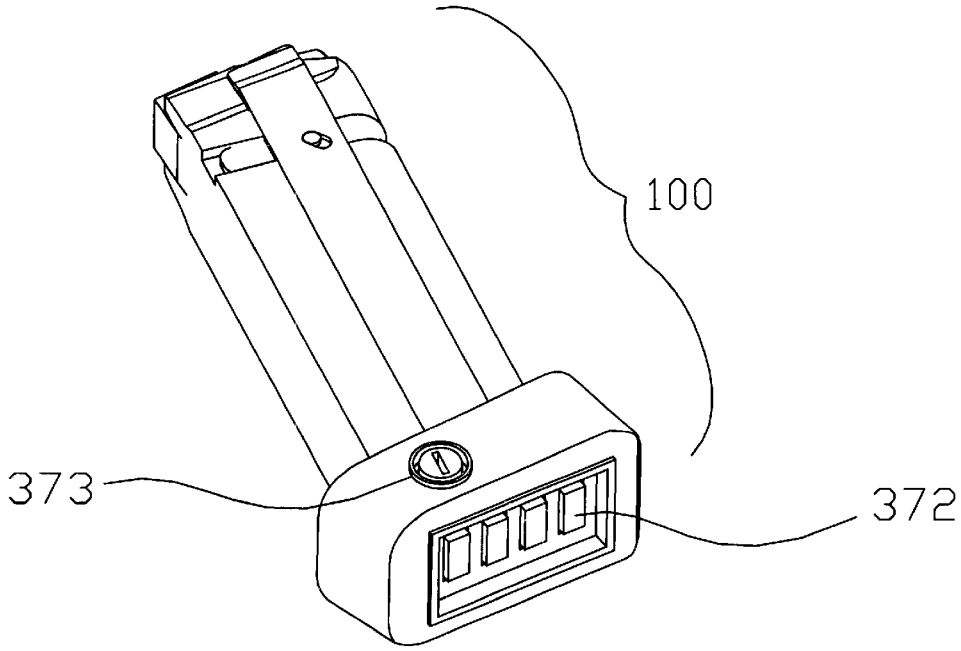

For example, and as shown in FIGS. 21(*a*) and 21(*b*), an authorized user may use specially configured key ring 302 or key 371 to mechanically controllably disable or enable at least portions of safety magazine 100. Key 371 is inserted by the authorized user into the centrally-disposed conventional key slot portion of key socket 373, which in turn is disposed on some portion of safety magazine 100. Alternatively, key ring 302 having circular key elements formed on the front face or other suitable portion thereof is inserted by the authorized user into the outer circularly-shaped key recess formed in key socket 373. Still further yet, an authorized user may simply punch a correct predetermined series of numbers into keypad 373 formed in a portion of safety magazine 100 to controllably disable or enable at least portions of safety magazine 100.

An external programming unit not shown in the Figures may also be employed in firearm system 5 to alter the functionality of, or update or change software loaded in, any one or more of firearm 10, safety magazine 100, safety magazine control module 186, external local enabling and/or communication device 300, and external remote enabling and/or communication device 350. In preferred embodiments of the present invention, such an external programming unit has a housing, keys, a display and an infrared transmitter or radio telemetry module for communicating with any one or more of devices 10, 100, 186, 300 and 350. Such a programming unit may be used to program or load new software in safety magazine control module 186 using infrared signals received by an input disposed in frame 12 or safety magazine 100, or using standard radio telemetry techniques well known in the art. Programming of safety magazine control module 187 may include any suitable coding or operational instructions. In still other embodiments of the present invention, other types of external programming units may be provided. The means by which communication or re-programming occurs may also be other than infrared or radio telemetric, such as by direct electrical connections or using an external magnet to open and close a reed switch disposed in safety magazine 100 and/or safety magazine control module 186. The programming unit may also be incorporated into safety magazine 100, or into external devices 300 or 350.

Alternatively, safety magazine control module 186 or safety magazine 100 need not be re-programmable, but instead may be sealed to prevent re-programming. Safety magazine 100 may also be configured to display program or function codes on an LCD display, and may also be provided with circuitry to provide audible tones as programming is changed and/or to signal low battery power. If desired, safety magazine control module may be configured to turn such circuitry ON and/or OFF.

As noted above, safety magazine 100 most preferably includes magazine locking member 148 so that if firearm 10 is stolen or wrongfully taken away from its rightful or authorized user, considerable time and effort will be required to remove safety magazine 100 from frame 12. Such a mechanism helps prevent firearm 10 from being used immediately used against its rightful or authorized user. Note that firearm system 5 of the present invention may be configured to include either or both of local external enabling and/or communication device 300 and remote external enabling and/or communication device 350.

I now describe further details of various embodiments of the present invention by referring to the Figures sequentially and in turn. FIG. 1 shows a block diagram of one embodiment of a firearm safety and control system of the present invention. Circuitry for firearm safety system 10 may be divided into three principal portions: (a) circuitry disposed in firearm frame 12; (b) circuitry disposed in safety magazine 100, and (c) circuitry disposed in local or remote communication or enabling device 300 or 350. Note, however, that at least some block diagram components of FIG. 1 shown as being disposed in safety magazine 100 may be disposed in firearm frame 12 or vice versa according to various embodiments of the present invention. For example, internal transceiver 210 may be located in frame 12 and not in safety magazine 100.

In FIG. 1, safety magazine 100 receives radio, electric, magnetic, electromagnetic or other types of suitable signals originating from external device 300 or 350 that either permit or do not permit firearm 10 to fire a projectile therefrom. In one embodiment of the present invention, safety magazine 100 contains internal transceiver or coil 210 which is capable of receiving in-range radio or magnetic signals emitted by external device 300 or 350, such signals enabling or disabling discharging of firearm system 10. External local communication or enabling device 300 or 350 may be stationary, moving or attached to the authorized person employing weapons system 10, and may comprise, by way of example, ring 302, watch 304, a bracelet, a necklace, badge 310, an implantable medical device 312, garment 314 or a portion thereof, hat 318 or a portion thereof, vehicle 354, external antenna 322, a headband, a helmet, an ankle bracelet, and the like. External remote communication or enabling device 350 may be stationary or moving, and may comprise, by way of example, satellite 352, vehicle 354, external antenna 322 or transmission tower 356.

Magazine control module 186 preferably comprises EEPROM, ROM, flash or other type of memory 204 which stores and/or is programmable with instructions for controlling various functions of safety magazine 100 and firearm 10, and most preferably comprises non-volatile memory. Magazine control module 186 receives input signals from internal transceiver or coil 210, and directs or controls first motion generation and translation assembly 118 accordingly. Upon receiving (or not receiving) a signal to permit or not permit discharge of firearm 10 from external transceiver or magnet 300 via internal transceiver or coil 210, magazine control module 186 sends (or does not send) control signals to assembly 118. In response to receiving (or not receiving) such a control signal from magazine control module 186, assembly 118 causes (or does not cause) certain of its magnetic, electrical and/or mechanical components to move (or not move) such that certain magnetic, electrical and/or mechanical components of interference member 116, magazine retaining assembly 146 and/or ammunition blocking assembly 176 of safety magazine 100 enable or disable operation of firing control mechanism 174 of firearm frame 12, more about which we say below.

Internal transceiver 210 is most preferably disposed in magazine control module 186 and forms a part or portion of safety magazine circuitry 212. In preferred embodiments of the present invention, transceiver 210 comprises or includes a hybrid or other communication chip connected to or forming part of circuitry 212, such as a MITEL KESTX01 single chip ASK (Amplitude Shift Key) transmitter IC (integrated circuit), a MITEL KESRX04 single chip ASK receiver IC, an RFM HX1000 433.92 MHz hybrid transmitter that generates on-off keyed (OOK) modulation from an external digital encoder, and/or an RFM RX1000 433.92 MHz ASH (amplifier-sequenced hybrid).

It is important to note that firearm 10 of the present invention may be configured to be either normally enabled or normally disabled when in-range signals transmitted by local or remote communication or enabling device 300 or 350 are detected by circuitry disposed within safety magazine 100.

In some embodiments of the present invention, firearm 10 may be fired or discharged, and/or its safety magazine 100 may be removed therefrom or inserted therein, by an authorized user so long as firearm 10 and corresponding safety magazine 100 are within range of enabling signals or communications transmitted by local or remote communication or enabling device 300 or 350 and one or more of interference member 116, magazine retaining assembly 146 or ammunition blocking assembly 176 are configured or acted upon so as not to interfere with the operation of firing control mechanism 174.

In still other embodiments of the present invention, firearm 10 may not be fired or discharged, and/or its safety magazine may not be removed therefrom or inserted therein, even by an authorized user, until or unless a predetermined code, signal, series of codes, or series of signals is transmitted to and sensed by circuitry typically disposed within safety magazine 100 and one or more of interference member 116, magazine retaining assembly 146 or ammunition blocking assembly 176 are acted upon to no longer interfere, or are not acted upon to interfere, with the operation of firing control mechanism 174.

In preferred embodiments of the present invention, firearm 10 is configured to permit projectile discharge or magazine removal/insertion by an authorized user; provided, however, that enabling signals transmitted by device 300 or 350 are within range of safety magazine 100 and are detected thereby. It is contemplated in one alternative embodiment of the present invention that firearm 10 is enabled in a manner similar to that described in U.S. Pat. No. 5,564,211, wherein external transceiver 301 continuously transmits a "disable" signal to safety magazine 100 but firing control mechanism 174 is disabled only when firearm bore 54 is pointed in the general direction of an authorized user wearing or carrying external transceiver 301 (thereby protecting the authorized user from being fired at by his own firearm 10, either accidentally or under the control of an unauthorized user).

Magazine power source 206 provides electrical power to magazine control module 186 and may also provide electrical power to other electrically powered components and circuitry disposed inside safety magazine 100 (such as assembly 118, internal transceiver 210, internal data acquisition system 216). Alternatively, a plurality of primary or secondary (i.e., backup) electrical power sources may be disposed, and provide electrical power to different components disposed, within safety magazine 100. Note further that internal data acquisition system 216 shown in FIG. 1 may be incorporated into or form a portion of magazine control module 186 and thus need not constitute a physically separate component apart from module 186. System 216 is optional and may be employed to acquire and/or store information such as the number of shots fired, the time and/or date shots were fired. the direction or azimuth shots were fired in, the authorized user who fired the shots, the location at which shots were fired, and the like. Likewise, external data acquisition system 360 is optional and may be employed to acquire and/or store information such as the number of shots fired, the time and/or date shots were fired, the direction or azimuth shots were fired in, the authorized user who fired the shots, the location at which shots were fired, and the like.

Magazine control module 186 generally comprises at least one of a CPU, microprocessor, microcontroller, encoder or the like, more about which we say below. To conserve battery power, magazine control module 186 may operate in a sleep or diminished power consumption mode until awakened by receipt of a predetermined code, signal, series of codes, or series of signals sensed by internal transceiver or coil 210 and originating from external local or remote communication or enabling device 300 or 350 (which, in turn, may be incorporated into a ring, radio, hat, bracelet, holster or the like worn or carried by an authorized user of firearm system 10 or may be located in an automobile or comprise a broadcast tower or satellite and corresponding ground station).

In another embodiment of the present invention useful for preserving or extending battery power, magazine control module 186 awakens periodically, searches for the presence of the proper signals emitted by external transceiver or magnet 301, and upon detecting such signals returns to a low power consumption sleep mode. It is contemplated that any of a number of power saving circuits and methods known to those skilled in the art may be adapted for use in, and fall within the scope of, the present invention. For example, safety magazine 100 may include a magnetic reed switch held in a predetermined open or closed position by magnets disposed in a holster and a ring worn by an authorized user. So long as the reed switch is held in the predetermined position which indicates the in-range presence of the magnet disposed in the holster or the ring, magazine control module need not awaken to cause disablement of firing control mechanism 174.

In one embodiment of the present invention, magazine control module 186 responds to the receipt or sensing of an in-range enabling (or disabling) signal transmitted by external transceiver 301 by transmitting a predetermined response signal to external transceiver 301. External transceiver 301, upon receiving the proper predetermined response signal from safety magazine 100 transmits a coded version of the predetermined response signal (or a verification signal) back to safety magazine 100. The verification signal is then detected by magazine control module 186 and first motion generation and translation assembly 118 is caused to act (or depending upon the particular embodiment of the present invention at hand not to act) upon interference member 116, magazine retaining assembly 146 and/or ammunition blocking assembly 176 thereby.

Figure 2:
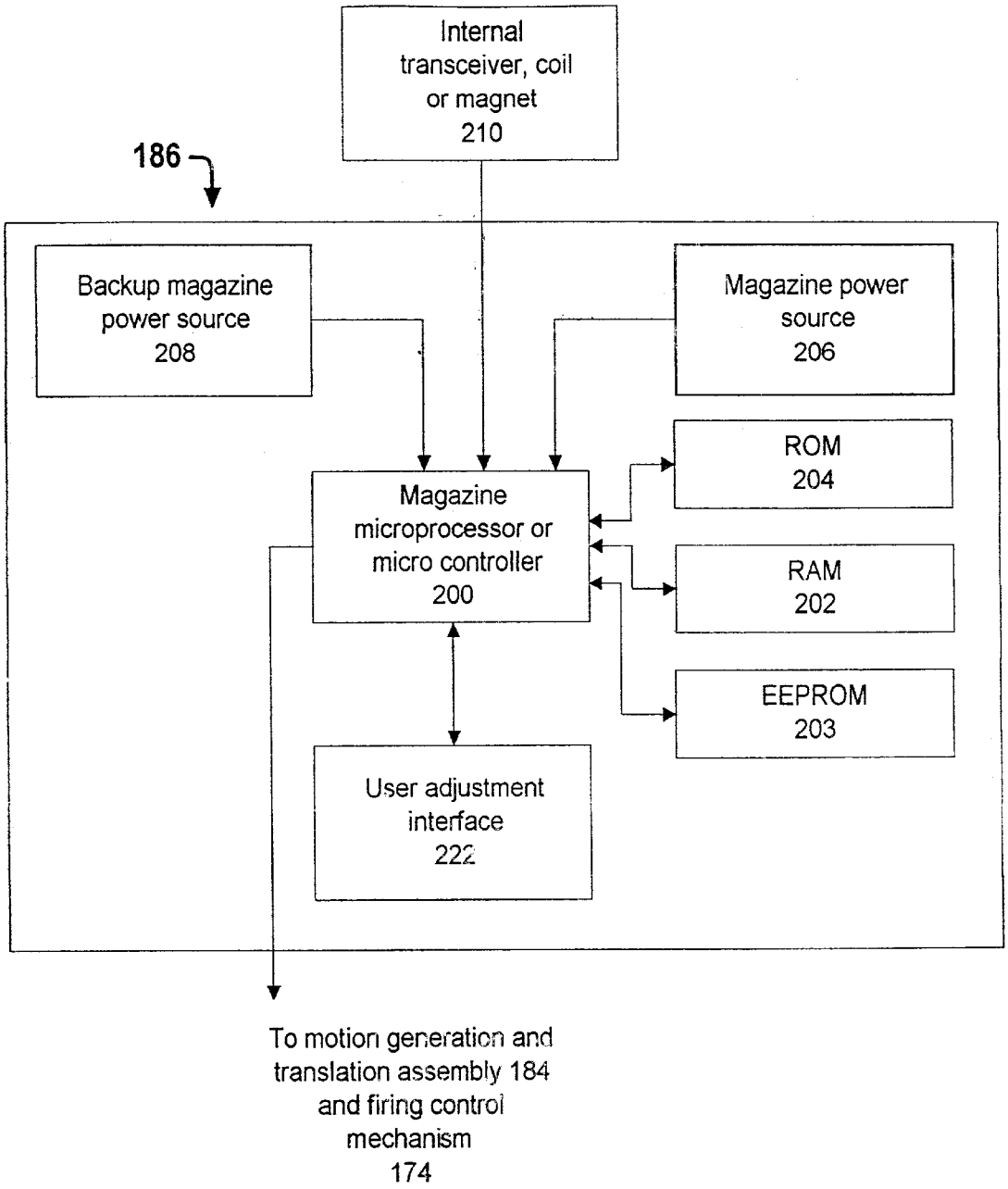
FIG. 2 shows a block diagram of one embodiment of a safety magazine control system of the present invention.

FIG. 2 shows a block diagram of one embodiment of safety magazine control module 186 of the present invention comprising magazine CPU, microprocessor, microcontroller or decoder 200, ROM 204, RAM 202, EEPROM 203, user adjustment interface 222, magazine power source 206 and backup magazine power source 208. Note that at least some block diagram components of FIG. 2 shown as being disposed in or forming part of magazine control module 186 may be disposed outside module 186 or left out entirely, and further that additional elements not shown in FIG. 2 may be included in module 186. For example, module 186 may not include one or more of backup magazine power source 208, EEPROM 203, ROM 204 or user adjustment interface 222.

Electrical power source 206 provides electrical power to CPU or decoder 200, and is most preferably a battery or electrochemical cell, but may also be a capacitor, fuel cell or the like. Backup electric power source 208 provides backup electrical power to CPU or decoder 200 in the event power source 206 fails or becomes inoperable, and is most preferably a battery or electrochemical cell, but may also be a capacitor, fuel cell or the like.

Element 200 in FIG. 2 may comprise one or more of a microprocessor, a microcontroller, a CPU, an encoder and a decoder and preferably, but not necessarily constitutes the "brain" or central control of firearm system 5. In another embodiment of the present invention, element 200 merely passes through control signals received from external remote or local communication or enabling device 300 or 350 to other elements of safety magazine 100 and firearm 10. Preprogrammed codes or instructions may be stored in ROM 204 and/or EEPROM 203 for controlling at least some functions of element 200. Codes or instructions stored in EEPROM 203 may be changed after initial programming through telemetric or user adjustment interface means.

Referring to FIG. 2, user adjustment interface 222 permits a user to controllably alter one or more functions of firearm 10 controlled by magazine control module 186. User adjustment interface 222 permits a user to selectively control and program element 200, and may be incorporated into safety magazine 100 or include a stand-alone programmer or external communication device. For example, user adjustment interface 222 may comprise a data, serial or parallel port or connector disposed in magazine 100 to which a cable may be attached for communication With an external programmer or computer. Alternatively, user adjustment interface 222 may comprise a button, series of buttons, LED, LEDs or keypad disposed on one of frame 12 or magazine 100 which a user employs to program or change the functionality of safety magazine 100 or firearm 10. User adjustment interface 222 may be eliminated altogether by a user sending programming information through internal transceiver 210 to element 200 from external transceiver 301 using external programmer/computer and radio telemetry downlinking and uplinking means well known in the art.

Figure 3:
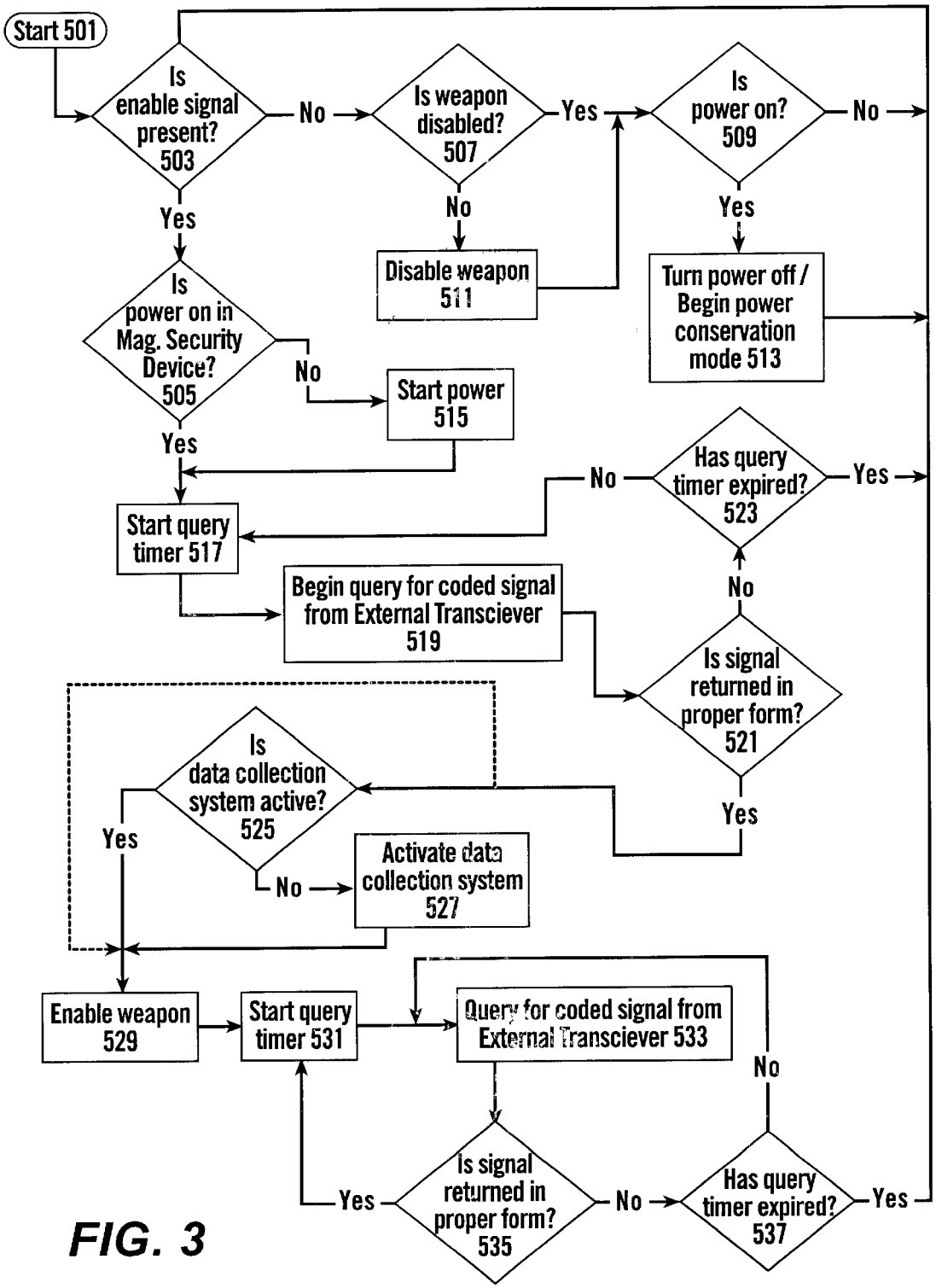
FIG. 3 shows a flow diagram corresponding to one embodiment of a firearm safety and control method of the present invention.

FIG. 3 shows a flow diagram corresponding to but one embodiment of a firearm safety and control method of the present invention. Note that not all steps illustrated in FIG. 3 are required for a method to fall within the scope of the present invention. For example, steps 509, 513, 511, 525 and 527 of FIG. 3, by way of example only, may be eliminated and yet yield a method falling within the scope of the present invention. Conversely, not all steps of the present invention are necessarily illustrated in FIG. 3. By way of example only, steps of adjusting or altering preprogrammed instructions residing in module 186 are not illustrated in FIG. 3 yet nevertheless fall within the scope of the present invention.

Referring now to FIG. 3, after start step 501, enable signal present step 503 is carried out. In step 503, some component or components of firearm system 5 determines whether an enable signal is present or detectable. For example, the in-range presence of ring 302 worn by an authorized user and having a magnetic element incorporated therein may be detected by coil 210 to thereby complete enable signal present step 503 and move on to step 505. If no enabling signal is detected or detectable in step 503, weapon disabled step 507 follows where it is determined whether or not firearm 10 is disabled and therefore unable to discharge a projectile. If firearm 10 is not disabled, firearm 10 is disabled in step 511. If firearm 10 is disabled in step 507, it is next determined whether or not electrical power is being provided to magazine control module 186. If electrical power is being provided to magazine control module 186, then such power is terminated in step 513.

When an enable signal is detected in step 503, it is next determined in step 505 whether electrical power is being provided to various components of safety magazine 100. If not, power is switched on in step 515. If so, a query timer is begun in step 517 that runs for a predetermined period of time. During that predetermined period of time, safety magazine 100 searches in step 519 for a predetermined code or signal being transmitted by external device 300 or 350. For example, a first predetermined code or signal may be transmitted by remote external device 350 that is received by antenna 322 located in ring 302 which, in turn, transmits a second predetermined code or signal to safety magazine 100. If the second predetermined signal transmitted by ring 302 matches characteristics stored in or sought by safety magazine 100 in step 521, firearm 10 or a portion thereof is enabled by magazine control module 186. Otherwise, upon the query timer expiring in step 523, query timer step 517 is begun again.

Optional steps 525 and 527 may be invoked upon successful completion of step 521. In optional steps 525 and 527, internal data acquisition system 216 is activated to acquire and/or store information relating to the operation and use of firearm 10 as described hereinabove. In step 529 firearm 10 is enabled, most preferably under the control of magazine control module 186. Upon successful completion of step 529, a second query timer (or the first query timer)

may be initiated in step 531. If a predetermined code or signal is detected by safety magazine 100 within the predetermined period of time during which the query timer runs, firearm 10 continues to be enabled such that firing control mechanism 174 is not interfered with by interference member 116 and/or ammunition blocking assembly 176 (and such that firearm 10 may be discharged by the authorized user), or such that magazine retaining assembly 146 is not activated to prevent removal of safety magazine 100 by the authorized user. If the predetermined signal or code is not detected within the predetermined period of time corresponding to steps 531 and 533, firearm 10 is disabled and the electrical power provided to safety magazine 100 is switched off in step 513. Once the provision of power to safety magazine 100 is interrupted, safety magazine 100 awaits the detection of the proper predetermined code or signal transmitted by external device 300 and/or 350 in step 503.

FIG. 4 shows a perspective view of one embodiment of firearm system 5 of the present invention. Although the present invention is generally described herein with reference to several embodiments shown in the drawings, it shall be understood that the various features of the present invention may be embodied in various different forms of alternative embodiments. In addition, any suitable sizes, shapes or types of elements or materials may be employed in the present invention. Various features of the present invention may also be incorporated into types of firearms other than a pistol or handgun, such as an automatic rifle, a submachine gun, a machine gun, a shotgun, an assault rifle, an UZI-type of gun, a target gun or rifle, a hunting gun or rifle, a flare gun, a race start gun, a tranquilizer gun, a tear gas or other type of gas cartridge gun, and so on.

Referring now to FIGS. 4 and 5, firearm frame 12 of system 5 receives safety magazine 100 of the present invention therein. In the embodiment of the present invention illustrated in FIG. 4, firearm frame 12 corresponds to an off-the-shelf, unmodified GLOCK® 17–23 Series semiautomatic firearm frame. Removable safety magazine 100 illustrated in FIG. 4, on the other hand, is not a stock magazine for a GLOCK® 17–23 Series handgun, but instead is specially constructed and configured safety magazine 100 of the present invention having certain features that render it capable of disabling at least one of the trigger, firing pin and ammunition conveyance mechanisms of frame 12 or magazine 100 to thereby prevent ammunition or other projectiles held in magazine 100 or firing chamber 50 from being fired by an unauthorized user. Safety magazine 100 of the present invention may further contain certain features that render it incapable of either being removed from or inserted in receiving portion or recess 18 of frame 12 by an unauthorized user. Those special features are actuated or de-actuated in accordance with signals received or not received by safety magazine circuitry 212 from external local or remote communication or enabling device 300 or 350. In the case of external local communication or enabling device 300, device 300 is generally worn or otherwise attached to or located nearby an authorized user. As described hereinabove, in the case of external remote communication or enabling device 350, device 350 may assume the form of an antenna, a broadcast tower, a combination ground station and satellite, a cellular telephone tower or satellite, and the like.

As illustrated partially in FIGS. 4 and 5, firing control mechanism 176 includes user actuated trigger 28 and trigger linkage mechanism 30. Trigger 28 is pivotably connected to main portion 14 of frame 12. In alternate embodiments of the present invention, trigger linkage 30 and trigger 28 may be slidingly or otherwise mounted in, on or to frame 12. Trigger linkage mechanism 30 most preferably includes a sear and a stop surface (not shown in the Figures). The sear is connected to a firing pin (not shown in the Figures) in slide 22. When trigger 28 is pulled to rotate rearwardly by a user, trigger linkage mechanism 30 moves the sear rearwardly next to a sear surface, which pushes against the sear. At an end of rearward travel, the sear surface disengages from the sear to allow a firing pin to propel forward to contact and discharge ammunition or projectile 48 from firing chamber 50 through bore 54.

In one embodiment of the present invention, when firearm frame 12 has safety magazine 100 of the present invention disposed therein, and firearm frame 12 and magazine 100 are removed a predetermined distance away from an authorized user (who is wearing or has attached to him a local communication or enabling device 300), circuitry 212 most preferably, although not necessarily, disposed in safety magazine 100 actuates first motion translation mechanism 118, which in turn causes interference member 116 to move into a predetermined position such that firing control mechanism 174 cannot operate to cause firearm 10 to fire a projectile therefrom.

Firing control mechanism 174 may include at least one of a stock safety lever or grip safety incorporated into stock unmodified firearm frame 12 (not shown in the drawings), trigger linkage mechanism 30, the sear or sear portion of trigger linkage mechanism 30 (not shown in the drawings), a firing pin linked to trigger linkage mechanism 30 (not shown in the drawings), and an ammunition blocking mechanism incorporated into safety magazine 100 or modified firearm frame 12. Disablement of any of the foregoing mechanical features by safety magazine 100 prevents firing of firearm 10 by an unauthorized user.

Safety magazine 100 most preferably is capable of holding a plurality of bullets or cartridges 48 that may be fed sequentially upwards into firing chamber 50 as an authorized user fires bullets 48. Bullets or shells 48 are fired from gun bore 54 through the combined actions of trigger mechanism 65 and firing pin mechanism 707 as is well understood in the art.

FIG. 5 shows an exploded perspective partial cross-sectional view of firearm safety and control system 5 of FIG. 4. Firearm frame 12 is shown to have a magazine receiving portion, cavity or recess 12 into or upon which removable ammunition safety magazine 100 fits. Safety magazine circuitry 212 (not shown explicitly in FIGS. 4 through 14) is most preferably disposed inside or otherwise forms a part of safety magazine 100. Alternatively, but less preferably, at least portions or components of safety magazine circuitry 212 may be located in or on frame 12. Circuitry 212 enables or disables discharge of firearm 10, and communicates or is enabled and/or disabled by either or both of local communication or enabling device 300 and/or remote communication or enabling device 350. Local communication or enabling device 300 in FIGS. 4 and 5 enables or disables discharge or firearm 10, or communicates with firearm 10, and optionally may communicate with, or be enabled or disabled by remote communication or enabling device 350. In another embodiment of the present invention, remote communication or enabling device 350 alone enables or disables discharge of firearm 10, and no local communication or enabling device 300 is provided in firearm system 5.

Figure 15:
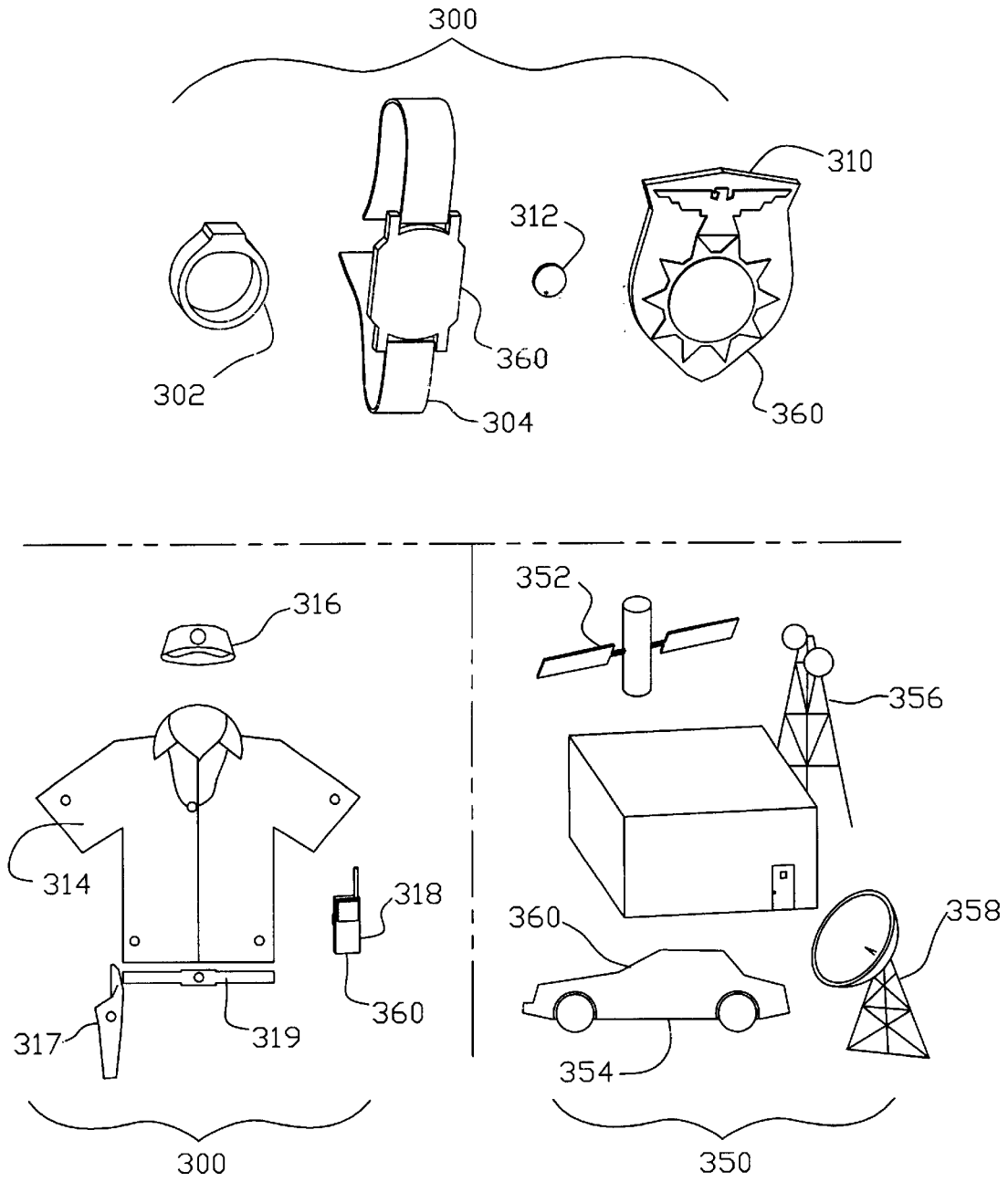
FIG. 15 shows various embodiments of some external local and remote communication or enabling devices 300 and 350 of the present invention.

Local communication or enabling device 300 assumes a preferred ring shape 302 in FIGS. 4 and 5, but may also assume any of a number of different structural configurations that may be worn or attached to a user (some of which are shown in FIG. 15) such as, for example, badge 310, belt 319, a pin, a wristband, watch-like device 304, a bracelet, a credit card or I.D. card shaped device, a thimble-shaped device, implantable hermetically sealed medical or body-attachable device 312, hat 316, shirt 314, radio 318, or may even be a device woven or otherwise attached to or incorporated into the clothing, headgear or footwear worn by an authorized user of firearm system 5.

Figure 6:
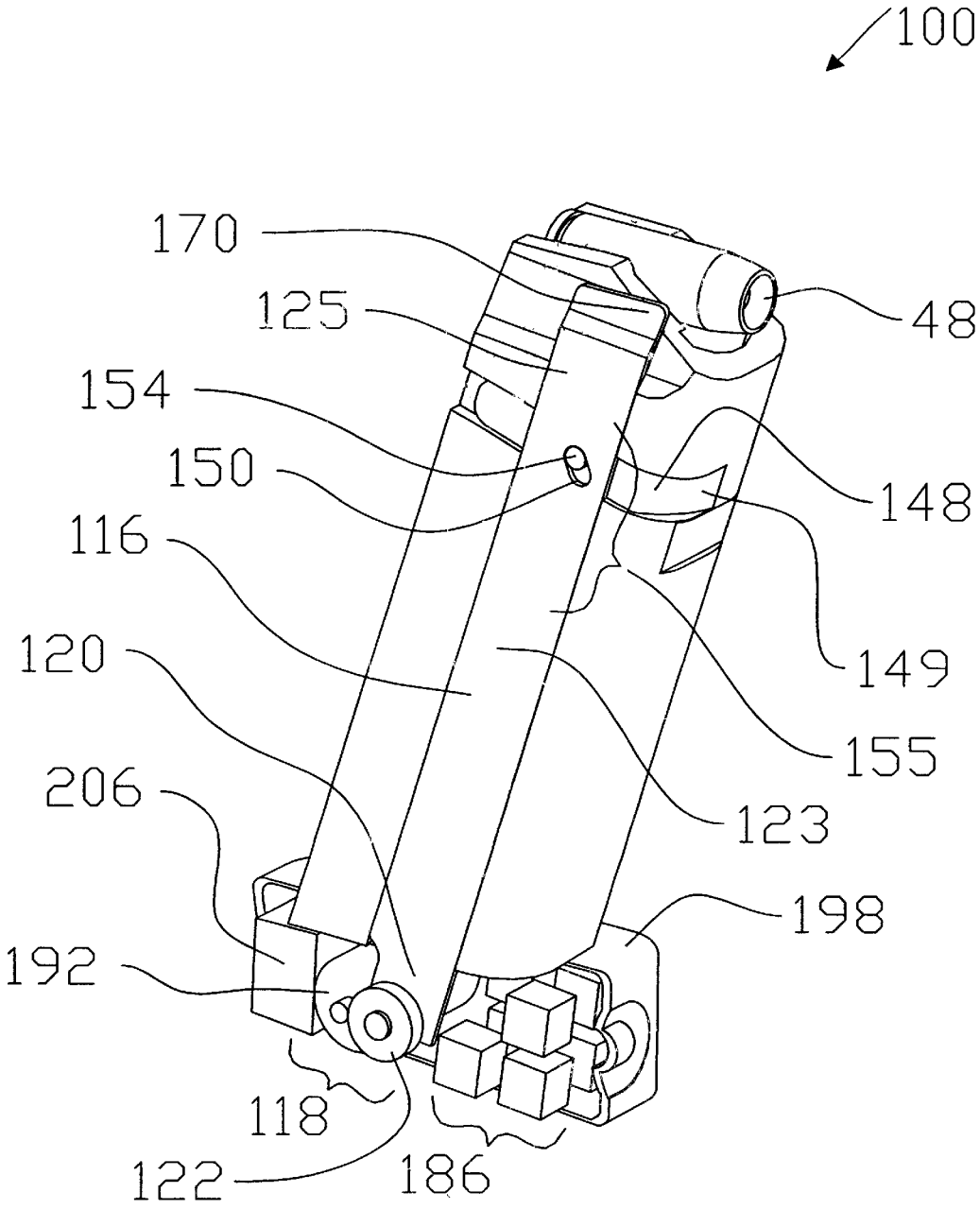
FIG. 6 shows an enlarged perspective view of safety magazine 100 shown in FIG. 5.

Some details of one embodiment of safety magazine 100 of the present invention are illustrated in FIG. 6. In that embodiment, safety magazine interference assembly 112 comprises interference member 116, motion generation device 192, first motion translation system 118, second motion translation system 155 and optional magazine locking member 148. Movement and/or actuation of elements 116, 192, 118, 148 and 155 occurs under the direction and control of safety magazine control module 186, which is most preferably disposed in housing 198. Magazine control module 186 is most preferably disposed in safety magazine 100, but may alternatively be disposed in frame 12 and have corresponding electrical contacts disposed in frame 12 and safety magazine 100 for conveying control instructions to appropriate components disposed in safety magazine 100.

Interference member 116 generally comprises at least one arm or lever, and in one embodiment of the present invention comprises lower portion 120, middle portion 123 and upper portion 125. Interference member 116 may comprise a plurality of arms, levers or links which engage or move in respect of one another by any of a wide variety of linkages or couplings that will become apparent to those skilled in the art upon reading the present specification and referring to the drawings hereof.

In one embodiment of the present invention, first motion translation mechanism 118 comprises lower portion 120 of interference member 116, to motion generation device 192 (which in turn may be an actuator, solenoid, motor or other suitable motion generation device), and an intermediate component or sub-system disposed between elements 120 and 192 which links those elements together to permit motion generated by motion generation device 192 to be transferred or translated to interference member 116 via lower portion 120. Such a linking intermediate component or sub-system may comprise corresponding magnetized regions, teeth and/or gears, at least one cam and corresponding at least one camped surface, pulleys and at least one belt, and the like, which engage one another and translate motion originating in device 192 to interference member 116 and/or optionally magazine locking member 148.

Still referring to FIG. 6, motion generation device 192 is incorporated into, or attached or connected to, safety magazine 100, and may be linked directly or indirectly to interference member 116. Motion generation device 192 most preferably comprises an electric motor, actuator, solenoid, or the like. In on embodiment of the present invention, when motion generation device 192 receives or does not receive a control or enabling signal from magazine control module 186 (depending on the nature of the particular communication or enabling scheme employed in the present invention) in response, for example, to firearm 10 being removed more than a predetermined distance away from external local communication or enabling device 300, or in response, for example, to safety magazine circuitry 212 receiving enabling or disabling signals or communications from external remote communication or enabling device 350, interference member 116 is moved from a normally non-interfering position into an interfering position through the operation of interference assembly 112. In the interfering position, interference or blocking member 116 physically blocks one or more of trigger linkage mechanism 30, the firing pin mechanism of firearm 10, the sear or sear portion of trigger linkage mechanism 30, and/or the ammunition conveyance mechanism of firearm 10 (to thereby prevent projectiles from being loaded into firing chamber 50).

Alternatively, interference member 116 may normally be held in an interfering position and moved into a non-interfering position only when communication or enabling device 300 or 350 is located within a predetermined distance of firearm 10. In such an alternative embodiment of the present invention, the loss of electrical power to motion generation device 192 may result in interference member 116 automatically moving into an interference position upon such power loss occurring.

Interference surface or portion 170 of interference member 116 is most preferably disposed in or near upper portion 125 of interference member 116, and in one embodiment of the present invention engages trigger linkage interference surface or portion 31 of trigger linkage 30 to thereby prevent trigger linkage 30 from causing the firing of ammunition 198 from firearm 10. That is, interference member 116 of the present invention moves on command of safety magazine control module 186 into an interfering position and is configured so as to interfere with, or prevent operation of, firing control mechanism 174 of firearm 10. Interference member 116 may be configured structurally in any of a number of different ways so as to prevent the operation of one or more of trigger 28, trigger linkage 30, firing pin 38, the ammunition conveyance mechanism disposed in safety magazine 100 (through the action of at least a portion of interference member 116 moving into an ammunition blocking position in safety magazine 100), the firing pin mechanism of firearm 10, the sear or a sear portion of trigger linkage 30 and/or magazine locking member 148.

Optional second motion translation mechanism 155 comprises middle portion 123 or upper portion 125 of interference member 116, magazine locking member 148, and an intermediate component or sub-system disposed therebetween for linking middle portion 123 or upper portion 125 and magazine locking member 148. Such linking mechanisms include corresponding magnetized regions, teeth and corresponding gears or teeth, at least one cam and corresponding at least one cammed surface, pulleys and at least one belt, and the like, which engage one another and translate motion from interference member 116 to magazine locking member 148.

In preferred embodiments of the present invention, magazine locking member 148 moves from a non-locking or magazine unlocked and removable position to a locked and magazine unremoveable position through the action of interference member 116 when interference member moves into an interfering position. In less preferred embodiments of the present invention, magazine locking member 148 is actuated by or linked mechanically, magnetically or electromagnetically to motion generation device 192 independently of interference member 116, and may thus may move into or from a locking position independent or simultaneous with movement of interference member 116.

In the embodiment of the present invention shown in FIG. 6, slot 150 is disposed in middle portion 123 or upper portion 125 of interference member 116, and accepts and engages magazine locking member pin 154 therewithin. Magazine locking assembly 146 preferably comprises magazine locking member 148, magazine locking member pin 154 and interference surface or portion 149 of magazine locking member. Magazine locking assembly 146 functions in cooperation with second motion translation system 155 and frame recess 20 of frame 10. Note that in some embodiments of the present invention magazine locking assembly 146 includes more than one locking member 148 for engaging more than one recess 20 disposed in frame 10. Magazine locking member 148 may or may not be spring-loaded and preferably comprises at least one arm, lever or link. Magazine locking member 148 may alternatively comprise a plurality or assembly of arms, levers or links which engage or move in respect of one another by any of a wide variety of linkages or couplings that should now become apparent to those skilled in the art.

In preferred embodiments of the present invention, safety magazine 100 and motion generation device 192 require electric current or power to permit interference member 116 to move from an interfering position to a non-interfering position. One or more round, coin, cylindrical, prismatic or custom-configured primary or secondary electrochemical cells or batteries 206 arranged electrically in parallel or series may provide such current or power.

Electrical power source 206 provides electrical power to CPU or decoder 200, motion generation device 192 and/or other devices or components, and most preferably comprises at least one battery or electrochemical cell, but may also comprise at least one capacitor, fuel cell or the like. Typically, optional backup electric power source 208 provides backup electrical power to CPU or decoder 200 other components in the event power source 206 fails or becomes inoperable, and like power source 206 is most preferably a battery or electrochemical cell, but may also be a capacitor, fuel cell or the like.

Electrochemical cells or batteries 206 are most preferably disposed in safety magazine 100 such that firearm frame 10 need not be modified to permit practice of the present invention in conjunction therewith. In the present invention, one or more primary or secondary electrochemical cells or batteries 206 that may be recharged externally or in-situ by conventional direct electrical coupling, inductive coupling or other means may be employed to recharge batteries or the like 206, which, in turn, provide electrical power to the various electrical and electronic components included in safety magazine circuitry 212. Such batteries 206 may be alkaline, zinc carbon, nickel-cadmium, lithium ion, nickel metal hydride, lithium manganese oxide, lithium thionyl chloride or other types of primary or secondary batteries housed in coin cell, round cell, prismatic, flat or otherwise shaped containers.

In other embodiments of the present invention, motion generation device 192 is a spring-loaded or otherwise mechanically biased device which is actuated by the removal of a corresponding magnet, coil, electromagnet or magnetized member incorporated into or forming at least a portion of local enabling or communication device 300. Upon such magnetic field and/or flux actuation and/or sensing, or electrical field and/or flux actuation and/or sensing, mechanical motion generation device 192 causes interference member 116 and/or magazine locking member 148 to move into corresponding enabling or disabling positions. Thus, some embodiments of firearm system 5 do not include an electrically powered magazine control module 186, and may even exclude module 186 altogether. In such an embodiment of safety magazine 100, magazine 100 may be removed from frame 10 after magazine locking member 148 has been placed into a locking position through the action of motion generation device 192 by, for example, a key or other specialized tool inserted by an authorized user into magazine 100, turning or manipulation of the key or tool causing magazine locking member 148 to move into a magazine unlocked position.

See, for example, keyed ring 500 shown in FIG. 21(*a*) having circular rim 502 disposed on face 504 thereof, rim 502 having grooves, indentations or projections 506 machined or formed therein, the grooves, indentations or projections fitting into correspondingly shaped recesses disposed in safety magazine 100. Insertion of rim 502 into such recesses in magazine 100 causes magazine locking member 148 to move into a magazine unlocked position. Rim 502 may be customized by appropriate individualized machining or forming such that each keyed ring 502 employed by an authorized user is unique and may unlock only one unique safety magazine 100 having correspondingly formed recesses disposed therein. Alternatively, magazine 100 may be fitted with a mechanically actuated keypad capable of causing magazine locking member 148 to move into a magazine unlocked position when a proper code is entered into the keypad. See FIG. 21(*b*).

Figure 7:
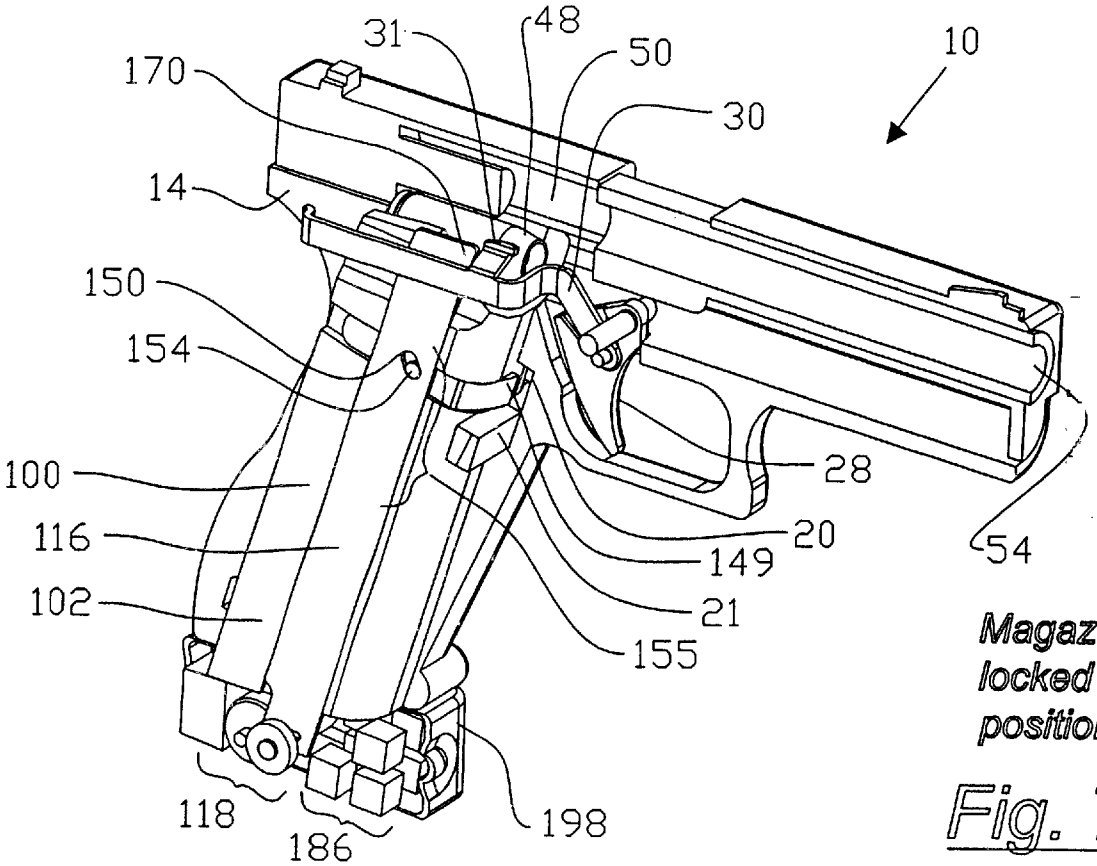
FIG. 7 shows a perspective assembled partial cross-sectional view of firearm system 10 shown in FIGS. 4 through 6, where firearm system 5 is in a disabled or locked condition and cannot be fired, and where local and remote communication and/or enabling devices 300 and 350 are not shown.
Figure 8:
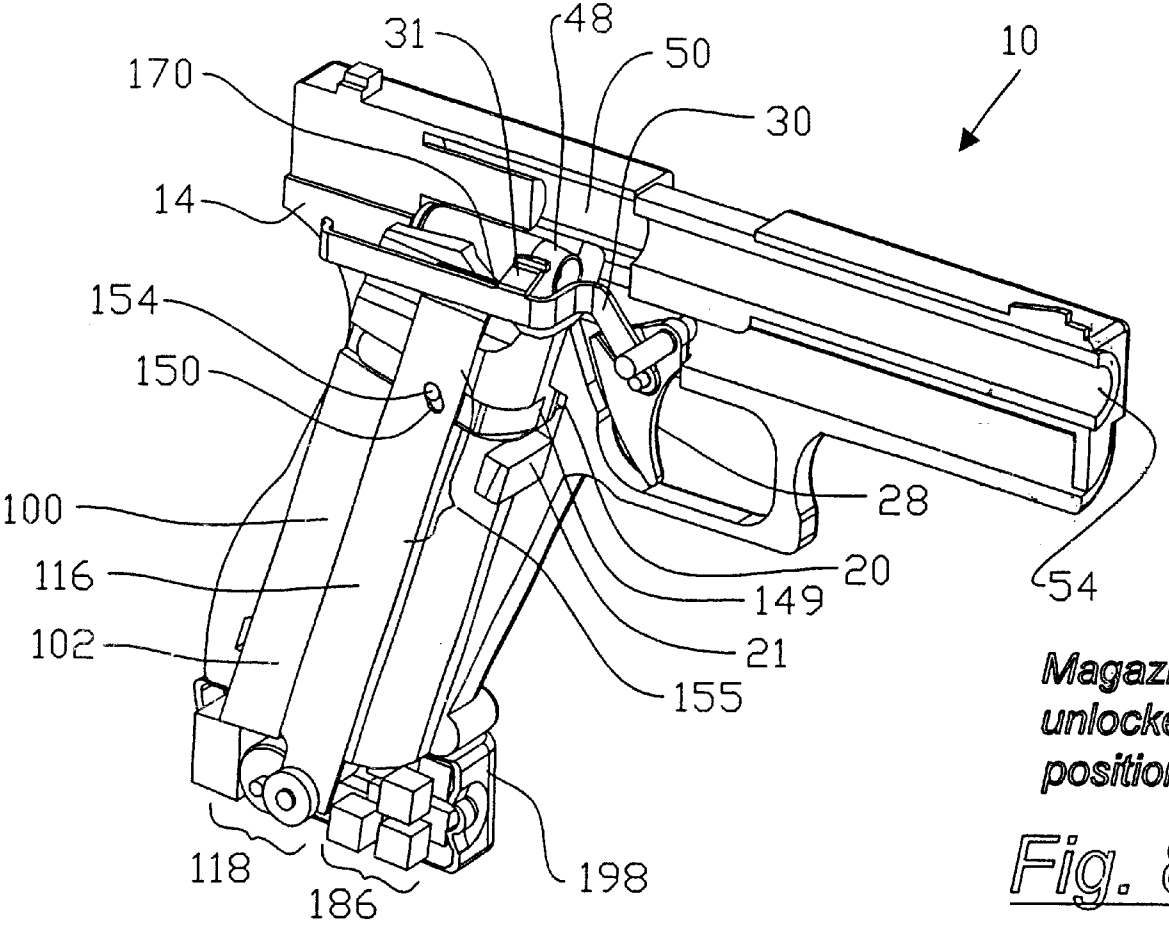
FIG. 8 shows a perspective assembled view of firearm system 10 of FIG. 7, where firearm system 5 is in an enabled or unlocked condition and may be fired.

Referring now to FIGS. 7 and 8, there is shown one embodiment of frame 10 and safety magazine 100 of the present invention in magazine locked and magazine unlocked positions, respectively. FIG. 7 shows a perspective assembled partial cross-sectional view of firearm system 10 of FIGS. 4 through 6, where firearm system 10 is in a disabled or locked condition and cannot be fired, and where local and remote communication or enabling devices 300 and 350 are not shown. FIG. 8 shows a perspective assembled view of firearm system 10 of FIG. 7, where firearm system 10 is in an enabled or unlocked condition and may be fired.

In FIG. 7, magazine locking member 148 is shown in a magazine locked position, where interference surface or portion 149 of magazine locking member 148 engages at least portions of, or is disposed at least partially in, corresponding frame receiving portion or recess 20 to thereby lock safety magazine 100 in recess 18 of frame 12. Continuing to refer to FIG. 7, interference member 116 is shown in an interfering position in respect of trigger linkage 30 of firing control mechanism 147, where interference portion or surface 170 engages trigger linkage interference surface or portion 31 to thereby prevent discharge of firearm 10. Element 21 shown in FIGS. 7 and 8 is a stock magazine release 21 connected to frame 12 for permitting removal of a conventional magazine. While trigger linkage 30 in FIGS. 7 and 8 is shown as being pivotably mounted or attached to frame 12, in alternate embodiments of the present invention trigger linkage mechanism may be slidingly or otherwise mounted in, on or to frame 12.

In FIG. 8, magazine locking member 148 is shown in a magazine unlocked position, where interference surface or portion 149 of magazine locking member 148 no longer engages at least portions of, or is no longer disposed at least partially in, corresponding frame receiving portion or recess 20 to thereby permit withdrawal of safety magazine 100 from recess 18 of frame 12. Continuing to refer to FIG. 8, and in respect of FIG. 7, motion generation device 192 has been actuated under the control of safety magazine control module 186 to cause interference member 116 to move into a non-interfering position, where interference portion or surface 170 has moved downwardly and away from engagement with, or disabling proximity from, interference portion or surface 31 of trigger linkage 30.

Figure 9:
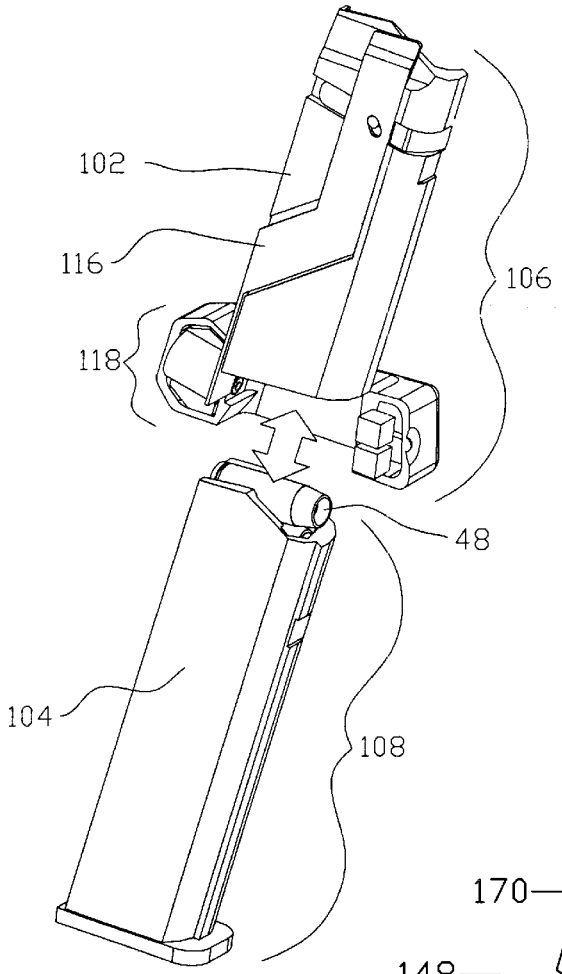
FIG. 9 shows an exploded perspective view of another embodiment of safety magazine 100 of the present invention.
Figure 10:
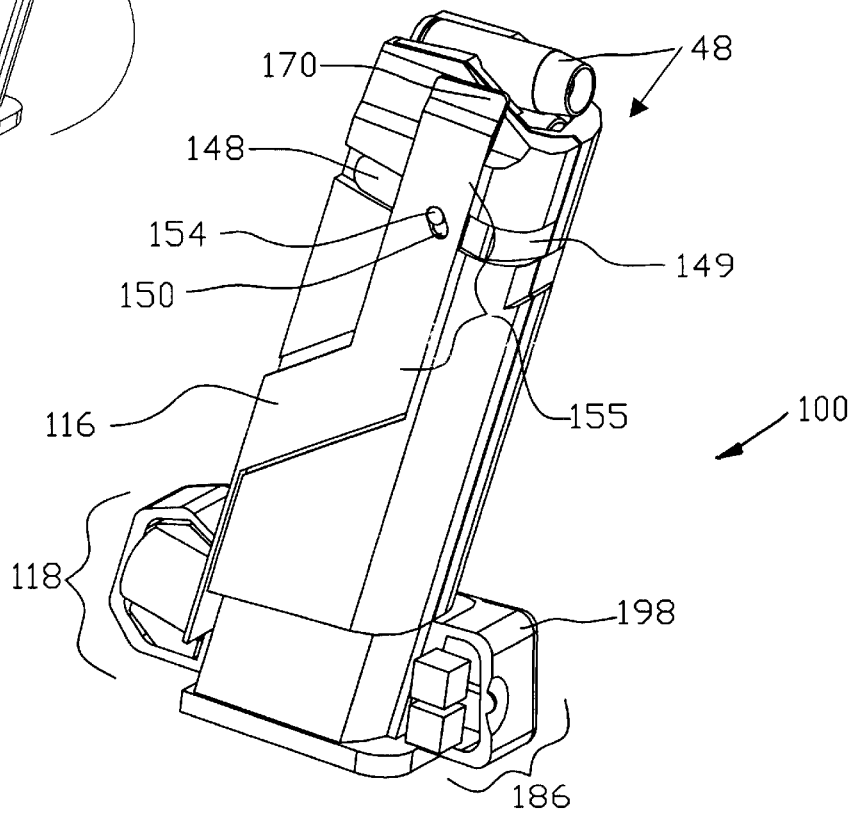
FIG. 10 shows a perspective view of safety magazine 100 of FIG. 9 in an assembled condition.

Referring now to FIGS. 9 and 10 there is shown one embodiment of safety magazine 100 of the present invention. FIG. 9 shows an exploded perspective view of such embodiment of the present invention, while FIG. 10 shows a perspective view of such embodiment where safety magazine 100 of FIG. 9 is illustrated in an assembled condition or state. FIG. 9 shows safety magazine 100 comprises two main components: magazine sleeve 102 and magazine chassis 104. Magazine chassis 104 generally includes "dumb" portion 108 of safety magazine 100 of the present invention. "Dumb" portion 108 holds or contains projectiles or ammunition 48 therewithin and, typically in cooperation with corresponding ammunition conveyance mechanisms disposed in frame 12, conveys ammunition from safety magazine 100 into firing chamber 50 of frame 12 as projectiles 48 are fired from firearm 10 by an authorized user. In preferred embodiments of the present invention, magazine sleeve 102 receives magazine chassis 104 therewithin, and generally comprises "smart" portion 106 of magazine 100. "Smart" portion 106 of safety magazine 100 generally comprises safety magazine circuitry 212, magazine power source 206, magazine sleeve 102, magazine interference assembly 112, magazine control module 186 and magazine control module housing 198.

Note that in some embodiments of the present invention safety magazine 100 comprises sleeve 102 and chassis 104 in unitary combination, where sleeve 102 and chassis 104 are not separable from one another, but instead comprise a structurally unitary single piece.

FIGS. 11 through 14 show side views of various embodiments of safety magazine 100 of the present invention and their associated first and second motion translation mechanisms 118 and 155, interference members 116 and magazine locking mechanisms 148.

Figure 11:
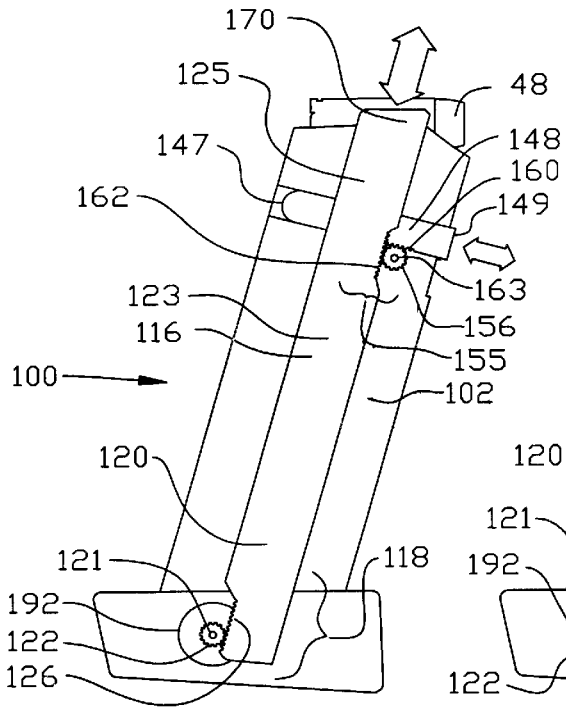
FIG. 11 shows a side view of yet another embodiment of safety magazine 100 of the present invention.

FIG. 11 shows a side view of one embodiment of safety magazine 100 of the present invention where first motion translation mechanism 118 comprises first gear 122, shaft 121, motion generation device 192, teeth 126 and lower portion 120 of interference member 116. First gear 122 is attached to shaft or output member 121 of motion generation device 192, and engages corresponding teeth 126 disposed on lower portion 120 of interference member 116. Rotation imparted to shaft 121 by motion generation device 192 causes first gear 121 to turn, which in turn through its engagement with teeth 126 causes interference member 116 to move upwardly or downwardly, depending on the selectable or controllable direction of rotation imparted to shaft 121 by motion generation device 192, into an interfering or non-interfering position in respect of at least one blocking or interfering portion of firearm control mechanism 174.

Figure 12:
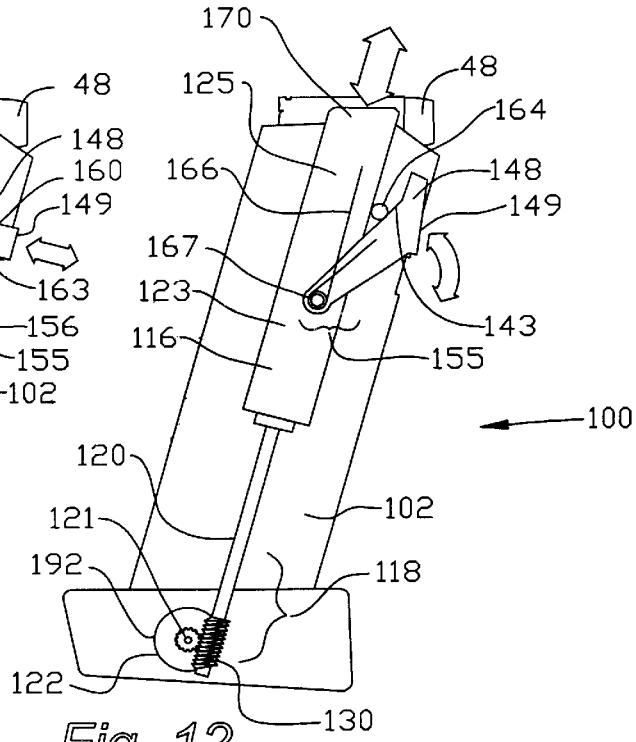
FIG. 12 shows a side view of still another embodiment of safety magazine 100 of the present invention.

FIG. 12 shows a side view of another embodiment of safety magazine 100 of the present invention where first motion translation mechanism 118 comprises first gear 122, shaft 121, motion generation device 192, worm gear surfaces 130, and lower portion 120 of interference member 116. Teeth disposed on first gear 122 engage corresponding worm gear surfaces 130 disposed on lower portion 120 of interference member 116. Rotation imparted to first gear 122 by shaft 121 and motion generation device 192 causes movement of interference member 116 into an interfering or non-interfering position in respect of at least one blocking or interfering portion of firearm control mechanism 174.

Figure 13:
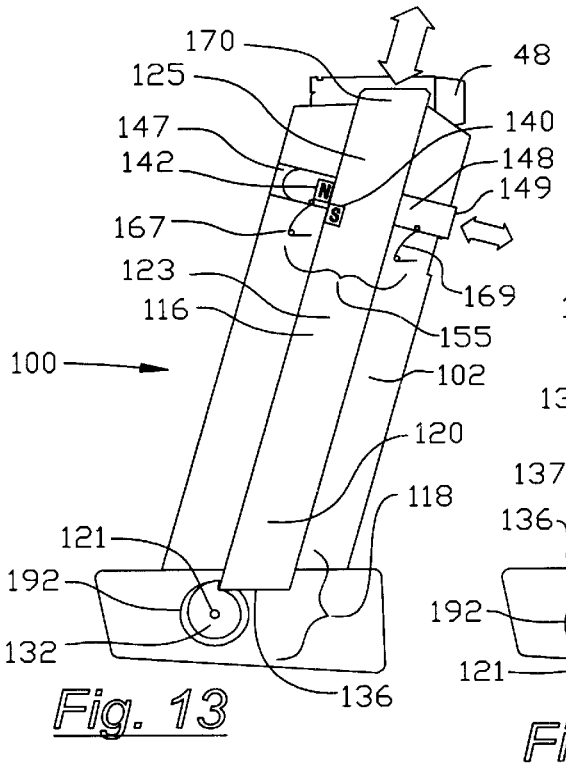
FIG. 13 shows a side view of a different embodiment of safety magazine 100 of the present invention.

FIG. 13 shows a side view of still another embodiment of safety magazine 100 of the present invention where first motion translation mechanism 118 comprises cam 132, shaft 121, motion generation device 192, cam engagement portion or surface 134, and lower portion 120 of interference member 116. Cam 132 is attached to shaft 121 of motion generation device 192. At least portions or a surface of cam 132 engage at least corresponding cam engagement portion or surface 134 disposed on lower portion 120 of interference member 116. Rotation imparted to cam 132 by shaft 121 and motion generation device 192 causes movement of interference member 116 into an interfering or non-interfering position in respect of at least one blocking or interfering portion of firearm control mechanism 174.

Figure 14:
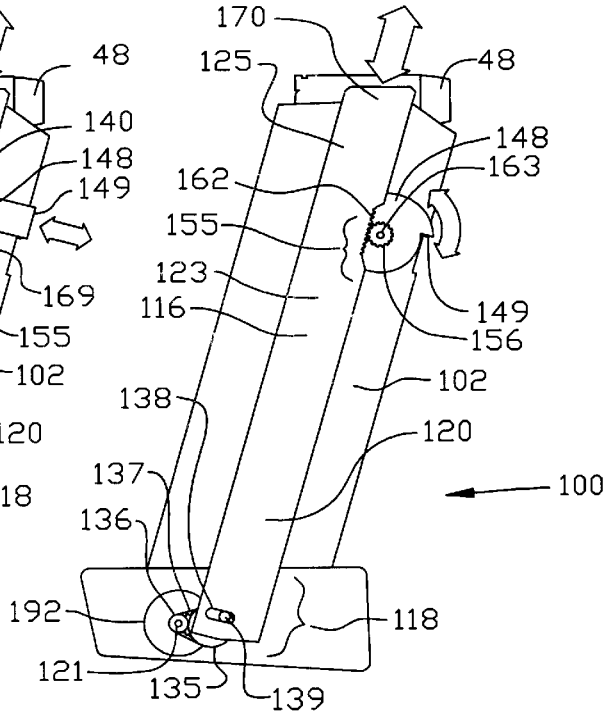
FIG. 14 shows a side view of another embodiment of safety magazine 100 of the present invention.

FIG. 14 shows a side view of yet another embodiment of safety magazine 100 of the present invention where first motion translation mechanism 118 comprises first pulley 136, belt 137, slot 138, second pulley 135, pin 139, shaft 121, motion generation device 192, and lower portion 120 of interference member 116. First pulley 136 is attached to shaft 121 of motion generation device 192, and engages corresponding second pulley 135 disposed on lower portion 120 of interference member 116 via belt 137. Slot 138 disposed in lower portion 120 of interference member 116 engages and accepts therewithin pin 139 mounted on second pulley 135. Rotation imparted to first pulley 136 (and thence to belt 136, second pulley 135 and pin 139 fixedly secured to a portion of second pulley 135) by shaft 121 and motion generation device 192 causes movement of interference member 116 into an interfering or non-interfering position in respect of at least one blocking or interfering portion of firearm control mechanism 174.

Referring to FIG. 11 again, there is shown a side view of one embodiment of safety magazine 100 of the present invention where second motion translation mechanism 155 comprises second gear 156, teeth 160, teeth 162, upper or middle portion 125 or 123 of interference member 116, shaft or pin 163, magazine locking member 148, interference portion or surface 149 of magazine locking member 148 and channel, slot or guide 147. Second gear 156 is preferably rotatable about pin or shaft 163, which in turn is preferably attached to some portion of sleeve 102. Movement of interference member 116 caused by actuation of motion generation device 192 causes movement of upper or middle portion 125 and/or 123 of interference member 116. Such movement causes second gear 156 to rotate through the engagement of corresponding teeth disposed on gear 156 and teeth 160 disposed on upper or middle portion 125 or 123 of interference member 116. The engagement of corresponding teeth disposed on gear 156 and teeth 160 disposed on magazine locking member 148 causes magazine locking member 148 to move along channel, slot or guide 147 into a magazine locking or unlocking position in respect of at least one feature such as recess 20 disposed on or in frame 12 and/or recess 18.

Referring to FIG. 12, there is shown a side view of one embodiment of safety magazine 100 of the present invention where second motion translation mechanism 155 comprises pin or engagement surface 164, upper edge 143 of magazine locking member 148, magazine locking member or spring-biased locking arm 148, joint 167, interference surface or portion 149 of arm 148, and spring 166. Pin or engagement surface 164 engages the upper edge of magazine locking member 148 and causes spring-biased arm 148 to rotate downwardly about joint 167 in response to the upward movement of interference member 116, caused in turn through the action of first motion translation mechanism 118. In a magazine locked position, interference surface or portion 149 of arm 148 engages at least one feature such as recess 20 disposed on or in frame 12 or recess 18 to thereby lock safety magazine 100 in frame 12. In a magazine unlocked position, interference surface or portion 149 of arm 148 is disengaged from recess 20 of frame 12, and the removal of safety magazine from recess 18 is permitted. Spring 166 may be employed to bias arm 148 into a normally magazine locked or normally magazine unlocked position, according to the dictates of the particular embodiment of the present invention at hand.

Referring to FIG. 13, there is shown a side view of one embodiment of safety magazine 100 of the present invention where second motion translation mechanism 155 comprises magazine locking member 148, upper or middle portion 125 or 123 of interference member 116, interference portion or surface 149 of magazine locking member 148, channel, slot or guide 147, first magnetized region 140 and corresponding second magnetized region 142.

First magnetized portion 140 is generally (although not necessarily) disposed in central portion 123 or in upper portion 125 of interference member 116. Corresponding second magnetized portion 142 is generally (although not necessarily) disposed in a portion of magazine locking member 148 which is propinquant to first magnetized portion 140 of interference member 16. Magazine locking member 148 is controllably moveable in channel, guide or slot 147 into magazine locked and magazine unlocked positions. Springs 167 and 169 are attached at one end thereof to sleeve 102 and at another end thereof to magazine locking member 148, and may be configured, depending on the particular embodiment of the present invention at hand, to either bias locking mechanism 148 in a normally magazine locked position or normally magazine unlocked position.

Magnetized portions 140 and 142 may be configured such that they magnetically repel or attract one another, depending on the design requirements of the particular embodiment of the present invention under consideration. Thus, by way of example, magnetized portion 142 may be disposed to the left or right of interference member 116, and magnetized portion 140 may be disposed above, below or in alignment with guide or channel 147.

Referring to FIG. 14, there is shown a side view of one embodiment of safety magazine 100 of the present invention where second motion translation mechanism 155 comprises rotatable magazine locking member 148, upper or middle portion 125 or 123 of interference member 116, interference portion or surface 149 of magazine locking member 148, second gear 156, and shaft or pin 163. Toothed second gear 156 is preferably rotatable about pin or shaft 163, which in turn is preferably attached to some portion of sleeve 102. Rotatable magazine locking member 148 rotates in conjunction with second gear 156, to which it is fixedly connected. Movement of interference member 116 caused by actuation of motion generation device 192 causes movement of upper or middle portion 125 and/or 123 of interference member 116. Such movement causes second gear 156 to rotate through the engagement of corresponding teeth 162 most preferably disposed on upper or middle portion middle portion 125 and/or 123 of interference member 116. The engagement of corresponding teeth disposed on gear 156 and 162 disposed on interference member 116 causes magazine locking member 148 to rotate into a magazine locking or unlocking position in respect of at least one feature such as recess 20 disposed on or in frame 12 and/or recess 18.

Note in particular that the most, if not all, of the various different first and second motion translation mechanisms illustrated in the Figures hereof may be combined in configurations not shown explicitly in the Figures and nevertheless fall well within the scope of the present invention. Note further that the first motion translation mechanism may be coupled to the motion generation device non-mechanical means, such as by magnetic coupling, electrical coupling and electromagnetic coupling. Additionally, the second motion translation mechanism may be coupled to the first motion translation mechanism (or alternatively directly to the motion generation device) by non-mechanical means, such as by magnetic coupling, electrical coupling and electromagnetic coupling.

FIG. 15 shows various embodiments of some external local communication and/or enabling devices 300 and external remote communication and/or enabling devices 350 of the present invention. External local communication or enabling device 300 may be stationary, moving or attached to an authorized person employing firearm system 5, or even not be attached or positioned on the authorized person employing firearm system 5. External local communication and/or enabling device 300 may comprise, by way of example, ring 302, watch 304, a bracelet, holster 317, a necklace, badge 310, an hermetically sealed, biocompatible and biostable implantable medical device 312, garment 314 or a portion thereof, hat 318 or a portion thereof, a portion of vehicle 354, an external antenna, a headband, a helmet, an ankle bracelet, or any other suitable device or article of clothing or footwear. External remote communication and/or enabling device 350 may be stationary or moving, and may comprise, by way of example, satellite 352, a portion of vehicle 354, an external antenna, radio or cellular telephone transmission or broadcast tower 356, or a combination of ground station/satellite dish 358 and satellite 352. Firearm system 5 of the present invention may include either or both of device 300 and device 350, and either or both of devices 300 and 350 may be employed to disable and/or enable either or both of firing control mechanism 174 and/or magazine locking mechanism 148. External data acquisition and storage device may form a portion of either or both of device 300 and device 350.

In another embodiment of the present invention, one or both of device 300 and device 350 comprise or are included in a Global Positioning System ("GPS"), Local Positioning System ("LPS"), or other type of communication system which employs matched electronic tags or transponders. At least a first electronic tag or transponder is disposed on magazine 100 or firearm 10. At least a second electronic tag or transponder, matched to the first electronic tag or transponder, is disposed in device 300 and/or device 350. When device 300 is removed a predetermined range away magazine 100 of the present invention as determined by the relative positions of the first and second tags or transponders, device 300 and/or device 350 transmits a signal or series of signals to magazine 100 to cause weapon 10 be rendered unfireable.

Figure 16:
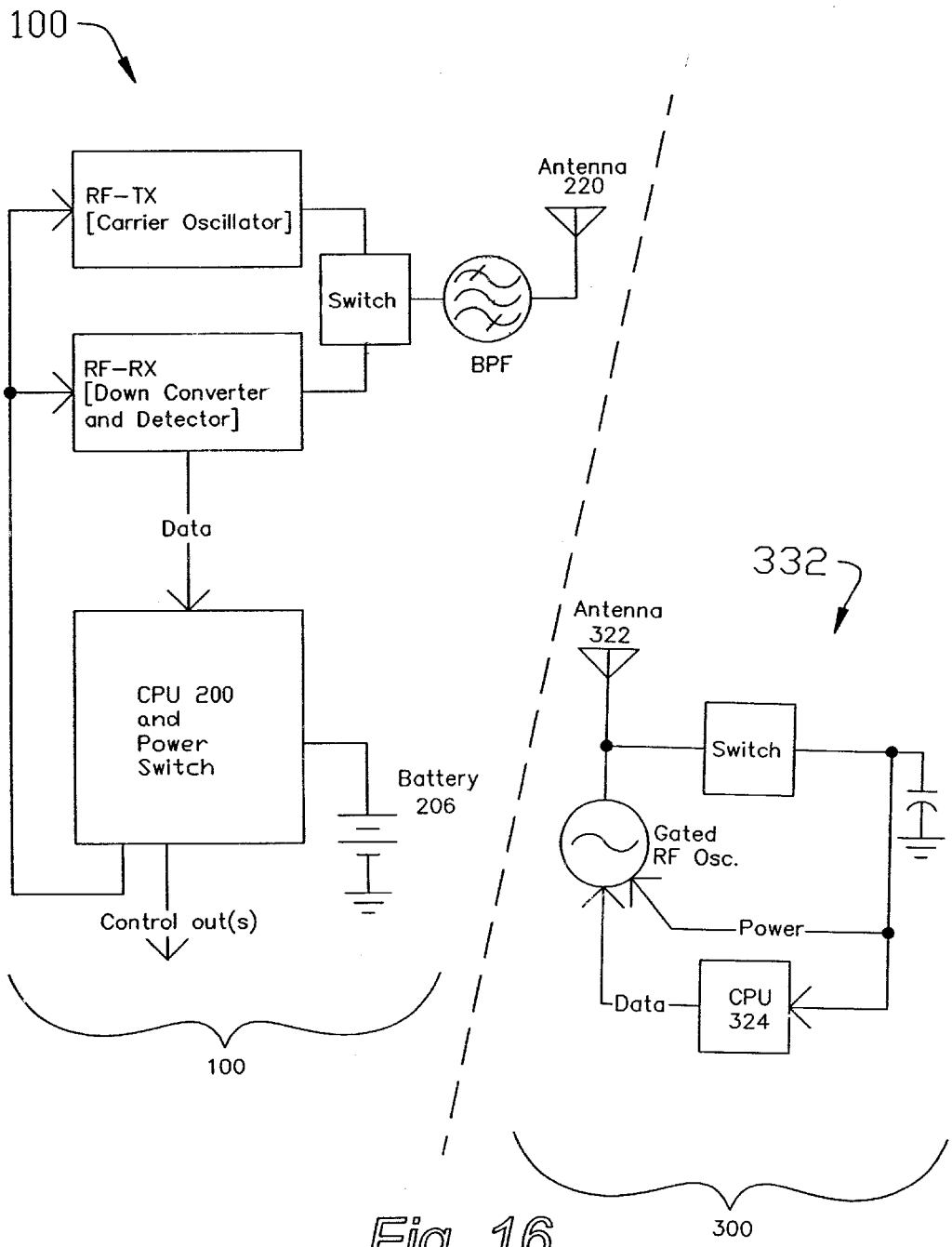
FIG. 16 shows a block diagram of one embodiment of a passive transceiver system of the present invention having no magnet or magnetic switch.
Figure 17:
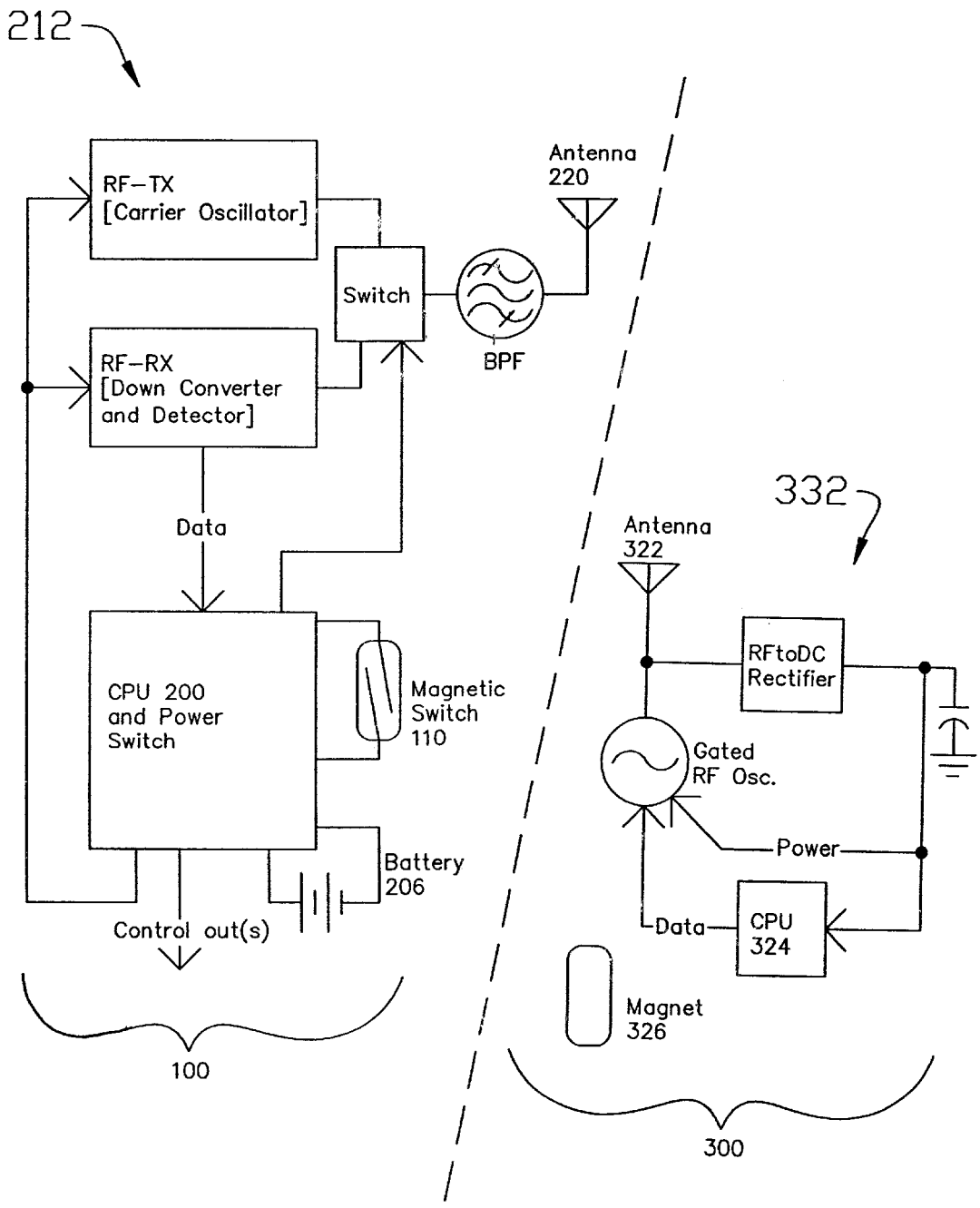
FIG. 17 shows a block diagram of one embodiment of a passive transponder system of the present invention having a magnet and magnetic switch.

FIG. 16 shows a block diagram of one embodiment of a passive transceiver or transponder system of the present invention comprising circuitry 212 having no magnetic switch 110, circuitry 212 being disposed most preferably in safety magazine 100, and local external enabling and/or communication device 300 comprising circuitry 332 having no magnet 326. FIG. 17 shows a block diagram of one embodiment of a passive transceiver or transponder system of the present invention comprising circuitry 212 having magnetic switch 110, circuitry 212 being disposed most preferably in safety magazine 100, and local external enabling and/or communication device 300 comprising circuitry 332 having magnet 326. Ring 302 or device 300 is termed "passive" here because ring 302 or device 300 contains no internal source of electrical charge or energy such as a battery. Instead, ring 302 or local device 300 is powered by an electric field generated and emitted by circuitry 212 of safety magazine 100. Safety magazine circuitry 212 of safety magazine 100 shown in FIGS. 16 through 18, contrariwise, does contain at least electrical power source 206.

Referring to FIG. 16, CPU 200 operates a transmitter for a predetermined period of time known to be sufficient to energize transponder circuitry 332 disposed in ring 302 or local device 300. At the end of that period of time, CPU 200 causes circuitry 212 to switch into a receive mode. Predetermined coded authorization signals are now transmitted through antenna 322 of circuitry 332 included in 302 to antenna 220 of circuitry 212 included in safety magazine 100. Circuitry 212 receives signals transmitted by circuitry 332 through an RF receiver, which in one embodiment of the present invention comprises a down converter and detector having a local oscillator. AM signal transmissions emanating from ring 302 are detected by UHF link circuitry included in circuitry 212 of safety magazine 100 similar to circuitry often employed in 418 MHz garage door opener circuits. CPU 200 in circuitry 212 detects and decodes data emanating from ring 302. When a predetermined coded authorization signal or series of such signals emanating from ring 302 is decoded by CPU 200 using, for example, a pattern matching program stored in the memory of CPU 200, and such signals are confirmed by CPU 200 as being correct or matching those stored in memory. CPU 200 and safety magazine control module 186 permit or enable firearm 10 to be fired by commanding motion generation device 192 to unlock one or more firing control mechanism and/or magazine locking members. To reduce battery power consumption, CPU 200 in circuitry 212 most preferably returns to a sleep mode after a certain predetermined period of time during which correct signals emanating from ring 302 are not detected in much the same way television remote control devices become dormant if not used within a certain predetermined period time.

Figure 18:
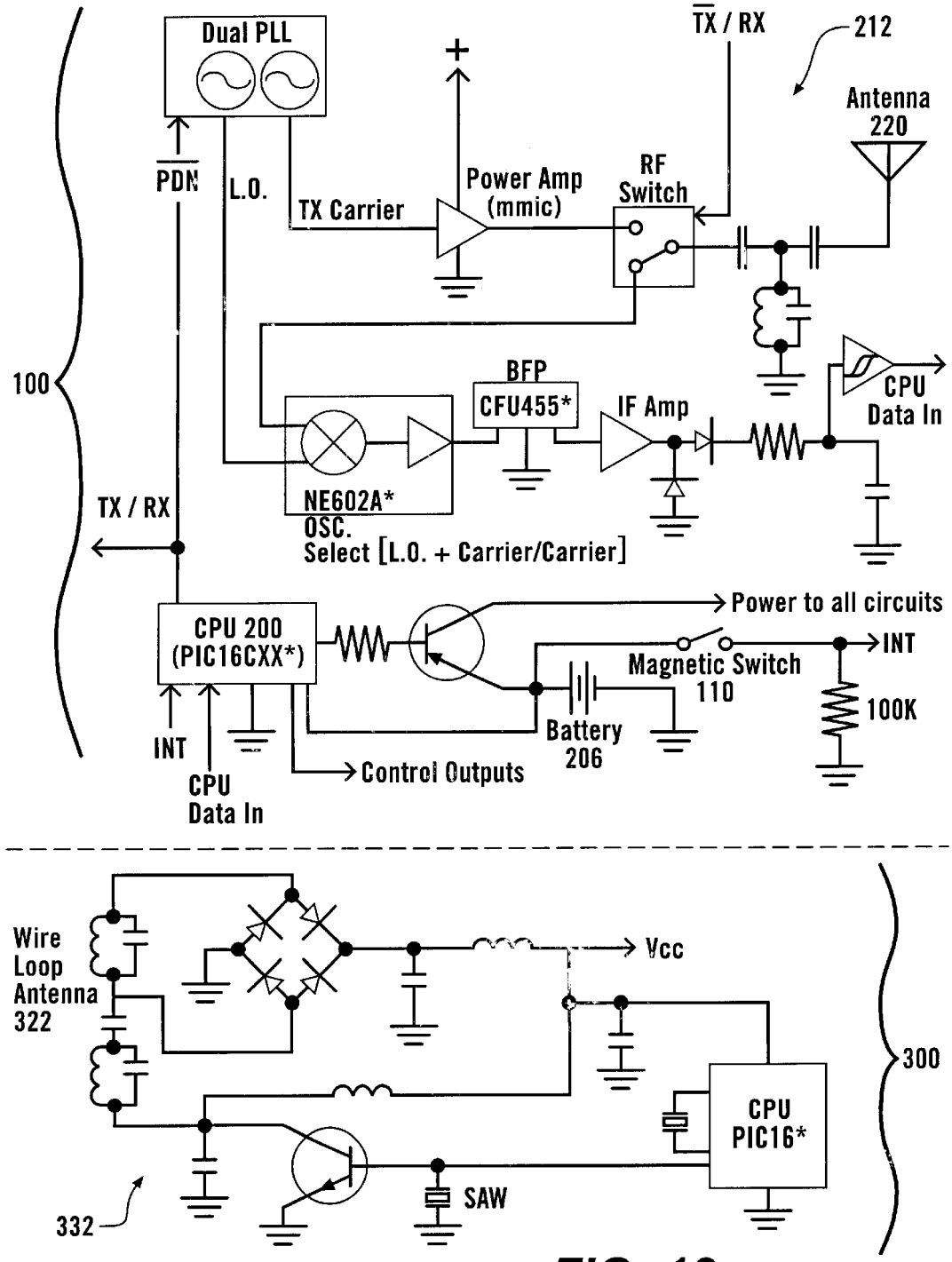
FIG. 18 shows a detailed circuit diagram of one embodiment of a passive transponder system of the present invention.

In passive transponder circuitry 212 and 332 shown in FIGS. 17 and 18, an authorized user wears ring 302 or other local external device 300 which contains magnet 326 mounted in such manner as to cause magnet 326 to come into close proximity with magnetic switch 110 included in circuitry 212 of safety magazine 100 when the user takes firearm 10 in his hand. Ring 302 or other device 300 may contain a gated RF oscillator, for example, which is modulated by CPU 324 disposed in ring 302. The gated RF oscillator and CPU 324 are powered electrically by energy received from an RF to DC rectifier included in circuitry 332 which is supplied electrical energy by an electric field generated by circuitry 212 of safety magazine 100.

In the embodiment of the present invention illustrated in FIGS. 17 and 18, an authorized user picks up firearm 10 weapon, magnet 326 in ring 302 closes reed or magnetic switch 110 in circuitry 212 included in safety magazine 100 which, in turn, wakes up idle CPU 200 in circuitry 212. CPU 200 then turns on a strong locally generated electric field, which energizes ring 302. Ring 302 receives a portion of such energy through tuned antenna 322 which is then routed to an RF to DC rectifier. This permits CPU 324 in ring 302 to become electrically powered and generate authorization codes, which it then employs to amplitude-modulate a gated RF oscillator (also contained within ring 302). Gated RF oscillator and CPU 324 thus generate a coded signal or series of signals which are transmitted through antenna 322 to antenna 220 of circuitry 212 of safety magazine 100.

Figures 19A, 19B, 19C:
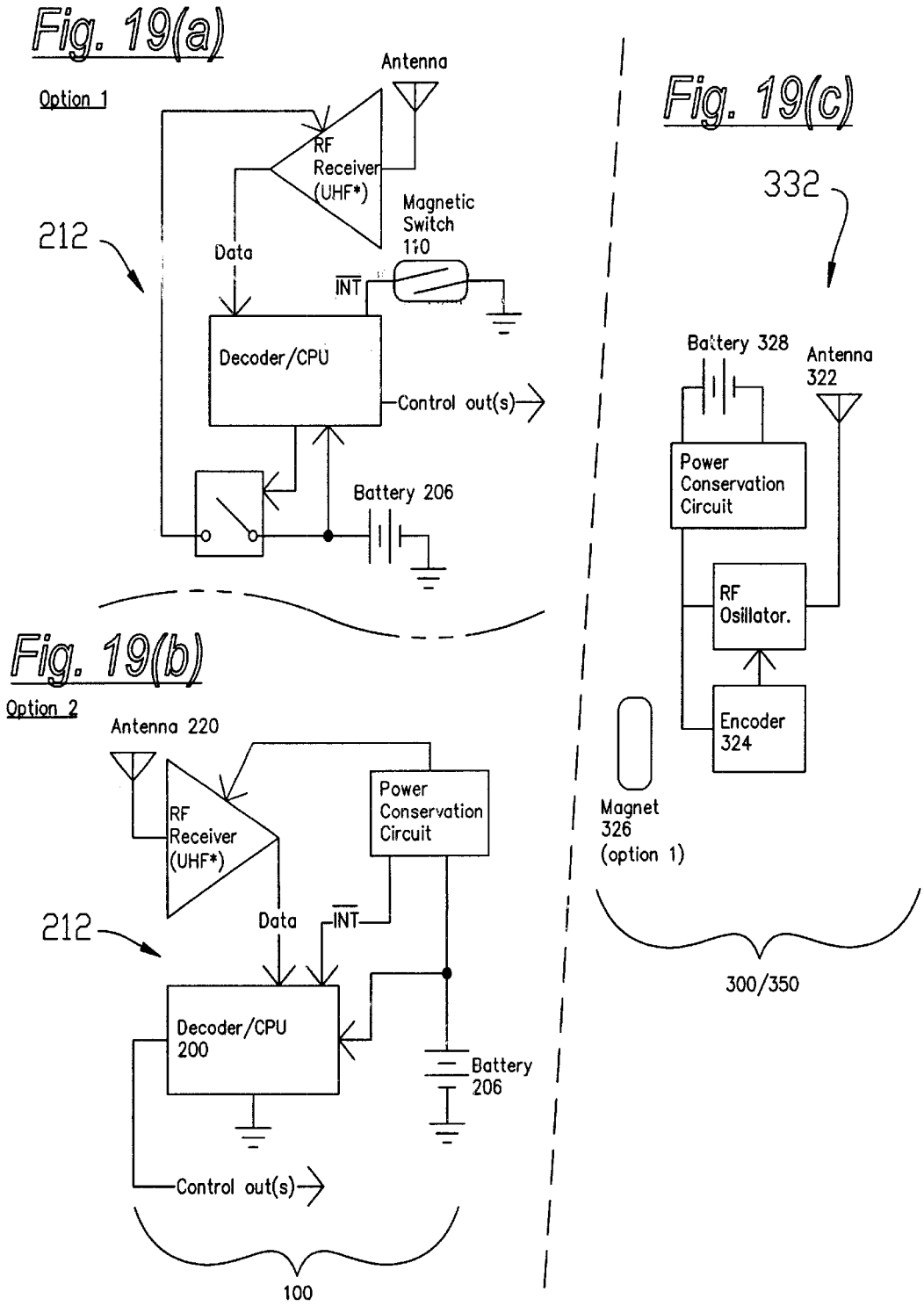
FIG. 19(*a*) shows one embodiment of a block diagram of an active transceiver system of the present invention.

FIG. 19(*a*) shows one embodiment of a block diagram of safety magazine circuitry 212 of the present invention, where local or remote device 300 or 350 comprises its own source of electrical power 328 and active circuitry 332. FIG. 19(*b*) shows another embodiment of a block diagram of safety magazine circuitry 212 of the present invention, where local or remote device 300 or 350 also comprises its own source of electrical power 328 and active circuitry 332. FIG. 19(*c*) shows one embodiment of a block diagram of external local and/or remote communication and/or enabling device circuitry 332 of the present invention corresponding to circuitry 212 of FIGS. 19(*a*) and 19(*b*).

Referring now to FIGS. 19(*a*), 19(*b*) and 19(*c*), there are shown two different embodiments of each of transceiver circuitry 212 and local or remote device circuitry 332, where magnet 326 and magnetic switch 110 are either included (option 1) or excluded (option 2). In one embodiment of the invention illustrated in FIGS. 19(*a*) through 19(*c*), an authorized user wears ring 302 or other local device 300 which, depending on whether circuitry 332 of option 1 or 2 is employed, either does or does not contain magnet 326. When circuitry 332 includes magnet 326, magnet 326 is mounted or otherwise positioned in such a manner as to cause magnet 326 to come into close proximity with magnetic switch 110 included in circuitry 212 of safety magazine 100 when the user takes firearm 10 in his hand. In the embodiment of the present invention illustrated in FIG. 19(*c*), ring 302 or local device 300 comprises an RF oscillator and an encoder which generates predetermined authorization codes transmitted by the RF oscillator. All circuitry disposed in ring 302 or local device 300 is most preferably gated on and off on at a low duty cycle rate. An example of a preferred embodiment of such a power-chopping circuit is an astable multivibrator or an astable flip-flop comprising two transistors switching on and off at a low frequency with a low duty cycle. Such a circuit cycles the electrical power provided to the encoder and RF oscillator on and off at regular intervals for short durations, and thus extends or maximizes battery life. Ring 302 or local device 300 is constantly and independently transmitting a predetermined coded authorization signal or series of signals for reception by antenna 220 and decoding by CPU 200 and the remainder of circuitry 212. In some embodiments of the present invention, and even in a "continuous" mode of operation, batteries disposed in circuitry 212 and/or circuitry 332 may function for up to several years without having to be replaced or recharged.

Referring to Receiver Option 1 illustrated in FIGS. 19(*b*) and 19(*c*), circuitry 212 (most preferably disposed in safety magazine 100) comprises an RF receiver and CPU/decoder 200. It is preferred that CPU/decoder 200 remain in sleep mode until magnet 326 in ring 302 or local device 300 comes into close proximity with magnetic switch 110 in circuitry 212, thereby interrupting and awakening CPU 200 in a manner similar to that in which many TV remote control devices are awakened by pressing a button provided thereon. Once CPU 200 is awakened the RF receiver is turned on. When a coded authorization signal or series of signals are received from external device 300 or ring 302, a pattern match program stored in the memory of CPU 200 is employed to determine if the received signals correspond to the predetermined signals or codes stored in the memory of CPU 200. If a match is found, circuitry 212 and safety magazine control module 186 enable or permit firearm 10 to be fired and/or magazine locking member 148 to assume a magazine unlocked position by commanding or causing motion generation device 192 to cause various means to unlock or not interfere with various firearm operation systems described hereinabove.

Referring now to Receiver Option 2 illustrated in FIGS. 19(*a*) and 19(*c*), circuitry 212 of safety magazine 100 is similar to circuitry 212 disclosed hereinabove concerning Receiver Option with exceptions that follow: No magnet 326 is required on or in ring 302 to initiate the power-up sequence of circuitry 212. Instead, receiver components of circuitry 212 continuously cycle on and off at a low duty cycle rate using astable multivibrator or other similar means. Thus, circuitry 212 of FIG. 19(*b*) is always in a receive mode. Battery life is extended, however, by the judicious selection of appropriately short, periodic pulses of activity for circuitry 212, as in Receiver Option 1, upon receipt of a correct authorization code or signal, circuitry 212 and safety magazine control module 186 permit or enable firing control mechanism 174 and/or magazine locking member 148 to function or unlock.

Figure 20B:
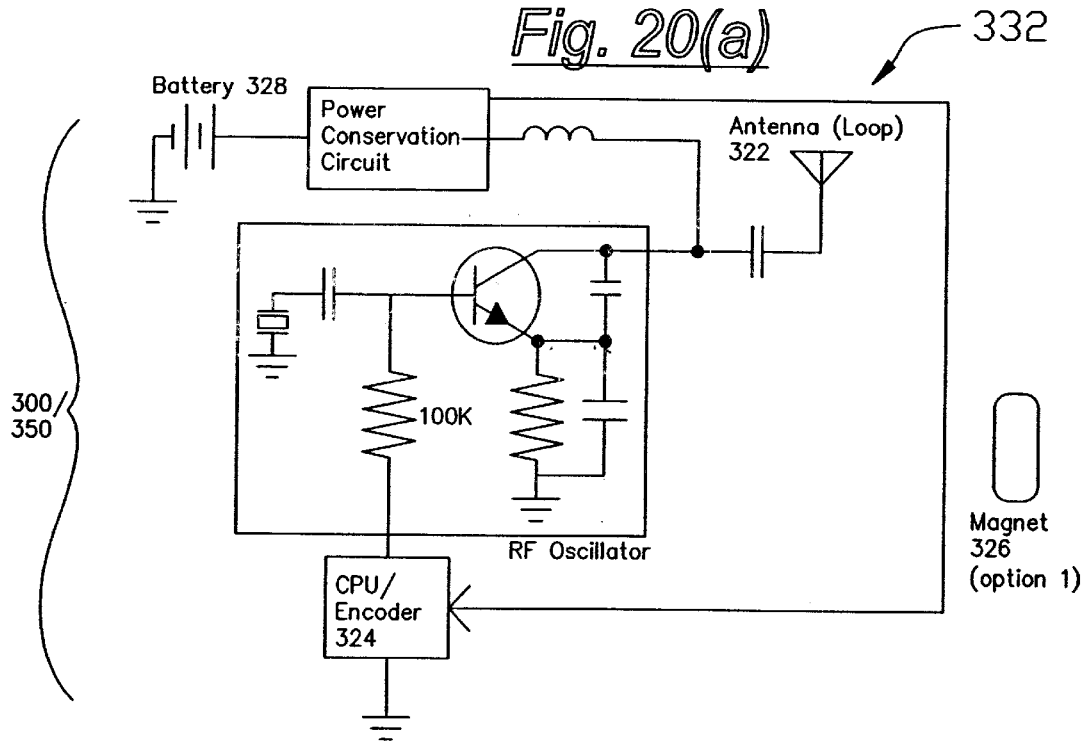
FIG. 20(*a*) shows a detailed circuit diagram of one embodiment of external local communication and/or enabling device active circuitry of the present invention.
Figure 20B:
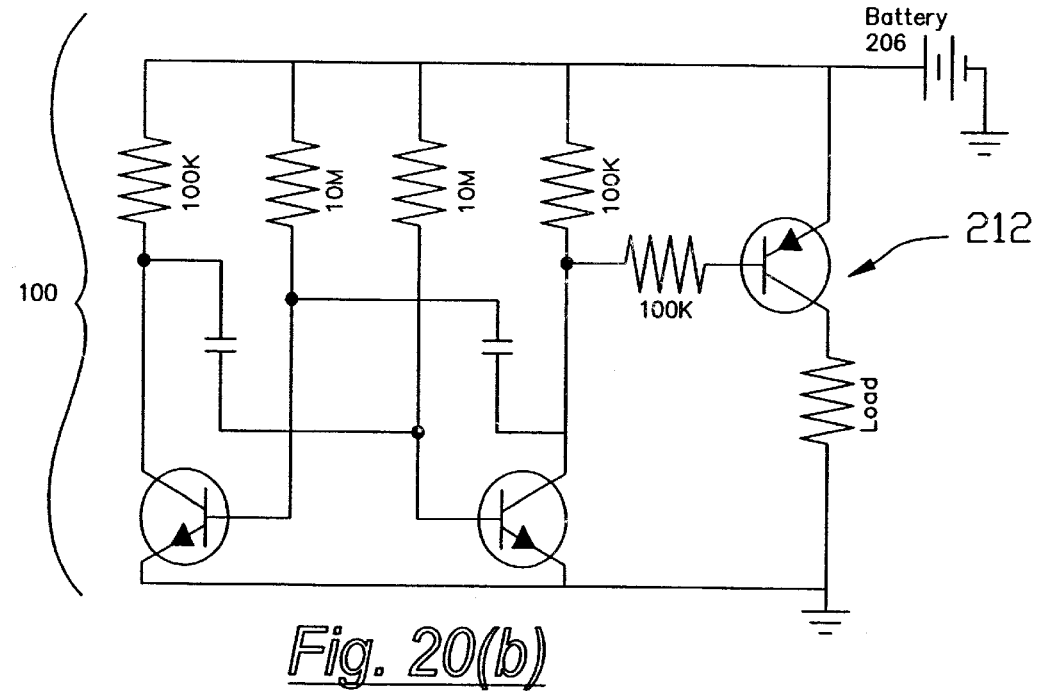

FIG. 20(*a*) shows a detailed circuit diagram of one embodiment of external local communication and/or enabling device circuitry 332 of the present invention. FIG. 20(*b*) shows a detailed circuit diagram of low duty cycle safety magazine circuitry 212 corresponding to circuitry of FIG. 20(*a*).

It should now be apparent to those skilled in the art upon reading and understanding the specification and drawings hereof that various permutations and combinations of the circuitry, systems, sub-systems, components and elements of the present invention disclosed herein may be removed, combined, permutated, and/or reconfigured in many ways not explicitly described or shown herein but which would nevertheless still perform the same or substantially the same function in the same or substantially the same environment and thus fall within the scope of the present invention. For example, an authorization sequence consisting only of a magnetic ring 302 and a magnetic switch 110 disposed in safety magazine 100 would certainly provide a certain level of user protection, and while not explicitly shown in the Figures, is certainly within the scope and spirit of the present invention. Systems which are normally enabled, systems which use types of signals not described explicitly herein, and systems which are authorized by means other than those disclosed explicitly herein still fall within the scope of the present invention. The few examples of the present invention shown or described herein are merely preferred embodiments thereof, and only a few of the workable alternative embodiments of the present invention which perform the same or substantially the same functions or tasks performed by the presently described systems.

It should therefore be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims. For example, the present invention includes within its scope a safety magazine containing circuitry that generates an electrical, magnetic, electromagnetic or other type of signal which communicates directly with an electronic firing assembly disposed in the frame of a gun, the output signal and electronic firing assembly being configured to cooperate with one another such that receipt of the output signal by the electronic firing assembly results in the electronic firing assembly being disabled or enabled. The devices disclosed in U.S. Pat. No. 4,793,085 to Surawski and U.S. Pat. No. 5,303,496 to Harthcock may be modified in accordance with the teachings of the present invention to achieve such a result. Note that firing control mechanism 174 set forth in the drawings and specification hereof is specifically intended to include electronic firing mechanisms such as those described hereinabove or in the referenced '085 or '496 patents. The output signal which enables or disables the electronic firing mechanism is generated in response to a local or remote signal emitted by an external device being received or sensed or not received or not sensed by circuitry disposed in the safety magazine.

In the claims, means-plus-function clauses are intended to cover the structures described herein as performing the recited function and their equivalents. Means plus function clauses are not intended to be limited to structural equivalents only, but are also intended to include structures which function equivalently in the environment of the claimed combination.

All patents or other printed publications disclosed hereinabove, including all patents listed in Table 1, are hereby incorporated by reference into the specification hereof, each in its respective entirety.

We claim:

1. A safety magazine for use in conjunction with at least one external enabling/disabling or communication device and a firearm frame for firing projectiles therefrom, the frame having a magazine volume for receiving the magazine, a firing chamber and a firing control mechanism, the safety magazine comprising:

(a) a projectile holding portion for holding the projectiles and conveying same to the firing chamber, and (b) a housing portion, comprising:

(i) a safety magazine control module having at least one of an antenna, a coil and a sensor for at least one of sensing and receiving at least one predetermined signal emitted by the external enabling or communication device, the magazine control module having circuitry connected to at least one of the antenna, the coil or the sensor for sensing or receiving the predetermined signal, the circuitry further comprising means for generating at least a first output control signal;

(ii) a motion generation device coupled to the means for generating the at least first output signal, the output control signal being provided to the motion generation device when the at least one predetermined signal is one of sensed and received or one of not sensed and not received, the motion generation device having an output member attached thereto or forming a portion thereof which moves in a first direction in response to the first output control signal being received by the motion generation device, and (iii) a first motion translation mechanism coupled to the motion generation device, the first motion translation mechanism comprising an interference member having an interference portion attached thereto or formed therein, the interference portion moving into a first interference portion position in response to the output member moving in the first direction and the first motion translation mechanism accordingly moving into a first motion translation mechanism position.

2. The safety magazine of claim 1, wherein the safety magazine is configured to be retrofittably received in the magazine receiving volume of a stock unmodified frame.

3. The safety magazine of claim 1, wherein the safety magazine is sized and shaped to be removeably connected to the frame.

4. The safety magazine of claim 1, wherein the motion generation device is selected from the group consisting of a solenoid, an actuator, a micromotor, a motor, a DC motor, an ac motor, a pneumatic device, an hydraulic device, a magnetic device, a coil, and a piezoelectric device.

5. The safety magazine of claim 1, wherein the safety magazine further comprises a second motion translation mechanism coupled to the motion translation mechanism.

6. The safety magazine of claim 5, wherein the second motion translation mechanism comprises a magazine locking member having a locking portion for engaging a corresponding locking feature disposed in the frame.

7. The safety magazine of claim 6, wherein the second motion translation mechanism is configured to cause the magazine locking member to move into a first locking position where the locking portion moves into the locking feature when the first motion translation system moves into the first motion translation position.

8. The safety magazine of claim 1, wherein the safety magazine further comprises a magazine locking member configured to retain the safety magazine in the firearm frame upon receipt or lack of receipt of the predetermined signal emitted by the external communication or enabling/disabling device.

9. The safety magazine of claim 1, wherein the interference member is configured to selectively interfere with or engage the firing control mechanism.

10. The safety magazine of claim 1, wherein the safety magazine further comprises a magazine sleeve and a magazine chassis, the magazine sleeve comprising the projectile portion and the magazine chassis comprising the housing portion.

11. The safety magazine of claim 1, wherein the means for generating the at least first output control signal comprises at least one of a microprocessor, a microcontroller, a CPU, a decoder, a signal sensing and control circuit, and a signal reception and control circuit.

12. The safety magazine of claim 1, wherein the magazine control module circuitry further comprises at least one of radio frequency receiver and radio transceiver circuitry coupled to the antenna.

13. A safety magazine for use in conjunction with at least one external enabling/disabling or communication device and a firearm frame for firing projectiles therefrom, the frame having a volume for receiving the magazine, a firing chamber and a firing control mechanism, the safety magazine comprising:

(a) a magazine chassis for holding the projectiles and conveying same to the firing chamber, and (b) a magazine sleeve having a magazine housing, the magazine chassis being received on, in, or incorporated into the housing, the magazine sleeve comprising:

(i) a safety magazine control module having at least one of an antenna, a coil and a sensor for at least one of sensing and receiving at least one predetermined signal emitted by the external enabling or communication device, the magazine control module having circuitry connected to at least one of the antenna, the coil or the sensor for sensing or receiving the predetermined signal, the circuitry further comprising at least one output control line and means for generating at least a first output control signal, the first output control signal being provided over the at least one output control line when the at least one predetermined signal is one of sensed and received or one of not sensed and not received;

(ii) a motion generation device connected to the at least one output control line, the motion generation device having an output member attached thereto or forming a portion thereof which moves in a first direction in response to the first control signal being received by the motion generation device over the at least one control line, and (iii) a first motion translation mechanism coupled to the motion generation device, the motion translation mechanism comprising an interference member having an interference portion attached thereto or formed therein, the interference portion moving into a first interference position in response to the motion generation device moving in the first direction and the first motion translation mechanism accordingly moving into a first blocking position, the first interference member at least one of engaging and interfering with the movement of at least a portion of the firing control mechanism when the interference member is in the first interference position.

14. A safety magazine for use in conjunction with at least one external enabling or communication device and a firearm frame for firing projectiles therefrom, the frame having a volume for receiving the magazine, a firing chamber and a firing control mechanism, the safety magazine comprising:

(a) a magazine chassis for holding the projectiles and conveying same to the firing chamber, and (b) a magazine sleeve having a magazine housing, the magazine chassis being received on, in, or incorporated into the housing, the magazine sleeve comprising:

(i) a safety magazine control module having at least one of an antenna, a coil and a sensor for at least one of sensing and receiving at least one predetermined signal emitted by the external enabling or communication device, the magazine control module having circuitry connected to at least one of the antenna, the coil and the sensor for sensing or receiving the predetermined signal, the circuitry further comprising at least one output control line and means for generating at least a first output control signal, the first output control signal being provided over the at least one output control line when the at least one predetermined signal is one of sensed and received or one of not sensed and not received;

(ii) a motion generation device connected to the at least one output control line, the motion generation device having an output member attached thereto or forming a portion thereof which moves in a first direction in response to the first control signal being received by the motion generation device over the at least one control line, and (iii) a first motion translation mechanism coupled to the motion generation device, the motion translation mechanism comprising an interference member having an interference portion attached thereto or formed therein, the interference portion moving into a first non-interfering position in response to the motion generation device moving in the first direction and the first motion translation mechanism accordingly moving into a first unblocking position, the first interference member at least one of disengaging and not interfering with the movement of at least a portion of the firing control mechanism when the interference member is in the first non-interfering position.

15. A safety magazine for use in conjunction with an external communication device and a firearm having portions which receive the safety magazine; the safety magazine comprising:

a housing;

a projectile holding portion received within the housing;

a control module mounted to the housing, the control module having a sensor which detects a signal emitted by the external communication device, and circuitry which generates a control signal in response to the detection of said emitted signal;

an interference member mounted to the housing, and movable between a first position which interferes with operation of the firearm, and a second position which permits operation of the firearm; and an actuator mounted to the housing and acting upon the interference member, wherein in response to the control signal the actuator moves the interference member from the first interfering position to the second operating position.

16. The safety magazine of claim 15 wherein the projectile holding portion is removable from the housing.

17. The safety magazine of claim 15 wherein the projectile holding portion is permanently fixed to the housing.

18. The safety magazine of claim 15 wherein the sensor is a radio transceiver operating near or in the 900 MHz range.

19. The safety magazine of claim 15 further comprising a magazine locking member mounted to the housing and movable between a first position which does not lock the housing to the firearm, and a second position which locks the housing to the firearm, and wherein the actuator acts upon the magazine locking member to move the magazine locking member from the first position to the second position.

20. The safety magazine of claim 19 wherein the control module has a reed switch positioned to be closed when brought into proximity of a magnet, and wherein closing of the reed switch causes the idle circuitry to wake up and brought into a condition to detect said control signal.

* * * * *